United States Patent [19]

Yumoto et al.

[11] Patent Number: 4,795,284

[45] Date of Patent: Jan. 3, 1989

[54] PRINTING DEVICE WITH CARRIAGE AND CARRIER THEREFOR EACH INTEGRALLY PRESS-FORMED FROM A RESPECTIVE METAL SHEET

[75] Inventors: Makoto Yumoto; Shoji Yanagida, both of Yokohama; Tomoyuki Moriya, Hiratsuka; Mamoru Takezawa, Yokohama; Shingo Kato, Yokohama; Osamu Kuramochi, Yokohama; Shunichi Ogawa, Hatano; Takashi Kimura, Yokohama; Takeshi Motohashi, Yokohama; Hideto Miyazaki, Yokohama; Eiji Hashimoto, Yokohama, all of Japan

[73] Assignee: Ricoh Company, Ltd., Tokyo, Japan

[21] Appl. No.: 925,155

[22] Filed: Oct. 31, 1986

[30] Foreign Application Priority Data

Nov. 1, 1985 [JP] Japan ..... 60-245960
Dec. 10, 1985 [JP] Japan ..... 60-276064

[51] Int. Cl.[4] ..... B41J 25/30
[52] U.S. Cl. ..... 400/352; 400/320

[58] Field of Search ..... 400/174, 175, 320, 352–357, 400/693, 694

[56] References Cited

U.S. PATENT DOCUMENTS

| | | | |
|---|---|---|---|
| 2,218,736 | 10/1940 | Avery | 400/693 |
| 2,305,292 | 12/1942 | Gerber | 400/693 |
| 3,899,065 | 8/1975 | Brignole | 400/208 |
| 4,049,109 | 9/1977 | Plaza | 400/352 X |
| 4,412,704 | 11/1983 | Gagnebin | 400/354.1 X |
| 4,514,101 | 4/1985 | Smith | 400/354 X |

*Primary Examiner*—Paul T. Sewell
*Attorney, Agent, or Firm*—Cooper & Dunham

[57] ABSTRACT

A printing device such as a printer of the type using a type wheel in which a carriage is loaded with a printing mechanism and movable along a carrier to allow the printing mechanism to print out data on a paper, which is wrapped around a platen. The carrier and/or the carriage is produced by press-forming a single sheet metal to cut down the production cost and the number of structural elements of the printer.

8 Claims, 38 Drawing Sheets

| Fig. 56 A | Fig. 56B |
|---|---|

Fig. 58

| 16 | 15 | 14 | 13 | 12 | 11 | 10 | 9 | 8 | 7 | 6 | 5 | 4 | 3 | 2 | 1 |
|---|---|---|---|---|---|---|---|---|---|---|---|---|---|---|---|
| 32 768 | 16 384 | 8192 | 4096 | 2048 | 1024 | 512 | 256 | 128 | 64 | 32 | 16 | 8 | 4 | 2 | 1 |

Fig. 59A

| 16 | 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | (0) |

AFTER 10 SECONDS

Fig. 59B

| 16 | 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|---|
| 0 | 0 | 1 | 0 | 0 | 1 | 1 | 1 | 0 | 0 | 0 | 1 | 0 | 0 | 0 | 0 | (10000) |

AFTER 55535 SECONDS

Fig. 59C

| 16 | 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | (65535) |

AFTER 0.001 SECONDS

Fig. 59D

| 16 | 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | (0) |

PRINTING DEVICE WITH CARRIAGE AND CARRIER THEREFOR EACH INTEGRALLY PRESS-FORMED FROM A RESPECTIVE METAL SHEET

BACKGROUND OF THE INVENTION

The present invention relates to a printing device.

Generally, in a printing device such as a one which uses a type wheel, a carriage is loaded with a printing mechanism and movable along a platen to allow the printing mechanism to print out information on a paper, which is wrapped around a platen. A printing device of the type described has various problems left unsolved, as described hereinafter.

A first problem stems from the carriage and carrier which have heretofore been implemented with die castings. Although die castings are suitable for mass-production and surface treatment such as plating and painting, they are thick and heavy and, therfore, a support shaft and a support rail adapted to support the carrier as well as side frames adapted to support the support shaft and support rail have to be considerably rigid. Besides, a bulky space motor is required to move such a thick and heavy carrier, increasing the production cost of a printing device.

A second problem is as follows. In a printing device of the type concerned, a platen is supported at both ends by side frames. A gear pulley is mounted on one of the side frames and an auxiliary pulley on the other, and a space wire is stretched between the two pulleys and connected to a carrier. The gear pulley is rotated by a space motor to move the carrier along a platen so that information may be printed on a paper, which is wrapped around the platen. The connecting position of the carrier to the space wire is a critical factor since it determines not only a printing position at which information is to be printed out on the paper but also whether the carrier is capable of moving over the entire width of the platen. It has been customary to connect the carrier to a space wire by fixing the carrier in a home position and winding the space wire around the gear pulley a predetermined number of turns. However, winding the space wire around the gear pulley a predetermined number of turns while holding the carrier in a home position as stated is undesirable since the manipulation for interconnecting the carrier and space wire is difficult and inaccurate.

A third problem is related to the orientation of a space motor. Specifically, a space motor installed in a printing device of the type described is usually mounted on a side frame in such an orientation that an output shaft thereof extends substantially horizontally. To meet a demand for a light-weight and small-size printer configuration, there has been developed a flat motor whose dimension along an output shaft thereof is short. A flat motor, however, brings about another problem that because the motor has a substantial length (width) in a direction perpendicular to the output shaft, positioning the motor such that the output shaft extends substantially horizontally invites an increase in the overall height of the printing device.

A fourth problem is derived from a prerequisite that in such a printing device, e.g. a one using a type wheel the reference position of a carriage relative to a carrier in a printing condition be set up with accuracy in order to enhance accurate printing. In a printer using a type wheel, for example, the front face of a carriage is rotated rearwardly in the event of replacement of the type wheel; in the event of printing, the carriage front face is rotated toward a platen. At this instant, should the carriage be stopped at different positions, the printing accuracy would be deteriorated. In light of this, a prior art printing device is provided with special reference setting mechansims, e.g., a reference plate mounted on a carrier and formed with a reference groove, a projection provided on a carriage to be received in the reference groove, and a mechanism for retaining the projection in the reference groove. Such a scheme cannot be embodied without adding to the cost since extra members have to be mounted on the carrier and carriage for setting up the reference print position.

A fifth problem is as follows. In a printing device of the type described, a platen is rotatably supported by right and left side frames, and the platen is rotated by a line feed motor. A carriage is movable along the platen to allow a printing mechanism mounted on the carriage to print out information on a paper, which is set on the platen. A prior art platen is produced by fitting a tube made of rubber around a tube made of steel, and press-fitting shafts, or rods, in both ends of the steel tube. Each of the shafts has a large diameter portion and a small diameter portion, the former being press-fitted in the steel tube. Another prior art platen comprises a cylindrical solid member made of aluminum alloy or the like, a tube made of rubber which is fitted around the solid member, and shafts which are press-fitted one in each of bores which are formed at both ends of the solid member. In any of such prior art platen configurations, because the shafts are produced independently of the steel tube or the solid member, or platen body, it is difficult to align the axes of the shafts with that of the platen body resulting in an increase in production cost. Further, the shafts which are press-fitted in the platen body adds to the weight of the platen and, thereby, bring about the need for a large output and expensive line feed motor which is adapted to drive the platen.

A sixth problem is related to backlash between intermeshing gears. In a printer of the type described, a platen is rotated, or indexed, to feed a paper to start a new line. Specifically, rotation of a line feed motor is transmitted to the platen by a motor gear which is mounted on the line feed motor, an idle gear, and a platen gear which is mounted on the platen. A prerequisite for the interline spacing to be maintained constant is that the platen be indexed by a constant amount and, therefore, the backlash between the motor gear had the idle gear and that between the idle gear and the platen gear be set up adequately. Usually, the platen is rotatably supported by side frames while the line feed motor is mounted to the side frames. Then, the idle gear is rotatably mounted to the side frame while adjusting both the backlash between the gear frame and the idle gear and the backlash between the idle gear and the platen gear. However, mounting the idle gear to the side frame while adjusting the two different kinds of backlash at the same time as stated is troublesome and inefficient. Moreover, such a procedure cannot readily establish adequate backlash, tending to lower the printing accuracy.

A seventh problem pertains to a paper feed mechanism. In a printing device of the type concerned, printing accuracy cannot be enhanced unless a paper is fed in tight contact with a platen. In light of this, a prior art printing device is provided with a deflector curved along a platen to guide a paper along the platen, feed rollers protruding toward the platen through slots which are formed in the deflector so as to urge a paper against the platen, a shaft on which the feed rollers are rotatably mounted, and an arm moving the shaft toward and away from the platen interlocked with the manipulation of a lever. When a paper is to be loaded on the platen, the feed rollers are retracted from the platen; after the paper has been loaded, the feed rollers are brought into contact with the platen to force the paper against the platen. This prior art implementation requires a disproportionate number of structural elements and, therefore, a disproportionate cost since the feed rollers are supported by the arm by way of the shaft.

An eighth problem also stems from the use of a die casting. A printing device of the type described has a housing which generally consists of a base cover and a top cover. The base cover is loaded with various electrical circuit elements and printing mechanisms while the top cover is mounted on the base cover in such a manner as to conceal them. The base cover has heretofore been implemented with a die casting which withstands painting for aesthetic purpose and desirably adapts itself to quantity production. However, as previously discussed, a die casting is thick and heavy and, moreover, expensive.

A ninth problem is as follows. A printing device of the type described involves various kinds of control and monitor processing which are based on time as typified by turn-on and turn-off control of LEDs representative of ribbon end and other errors as well as statuses of various switches arranged on a control panel, e.g., pose switch, energization control of buzzers, monitoring of switches disposed on the control panel and a rear panel as well as sensor switches, and monitoring of reception of data from a host machine. A prior art printing device includes exclusive timers for interface control so that such various kinds of control and monitoring which are based on time may be subjected to interface control. However, assigning one exclusive timer for interface control to each of the different kinds of control renders the construction complicated. When a single timer is shared by different controls, on the other hand, while any one of the controls occupies the timer the others cannot use the timer.

SUMMARY OF THE INVENTION

It is a first object of the present invention to solve the first problem as previously stated, i.e., to cut down the production costs of a carriage and a carrier and, thereby, the cost of a space motor and others and, thereby that of a printing device as a whole by using a carrier and/or a carriage which is produced by pressforming a sheet metal.

It is a second object of the present invention to solve the second problem, i.e., to facilitate easy and, yet, accurate interconnection of a carrier and a space wire by fixing a fixing plate to a space wire beforehand and connecting the fixing plate to the carrier afterwards to interconnect the carrier and the space wire.

It is a third object of the present invention to solve the third problem, i.e., to reduce the vertical dimension of a space motor and, thereby, that of a printing device as a whole by orienting the space motor such that an output shaft thereof extends substantially vertically.

It is a fourth object of the present invention to solve the fourth problem, i.e., to cut down the cost of a printing device by defining a reference printing position on the basis of abutment of the upper end of bearings of a carrier and the lower end of a carriage.

It is a fifth object of the present invention to solve the fifth problem, i.e., to faciliate alignment of a platen so as to lower the production cost of a platen and to reduce the weight of a platen so as to cut down the cost of a printing device.

It is a sixth object of the present invention to solve the sixth problem, i.e., to allow an idle gear to be mounted simply and easily so that efficient assemblage of a printing device and accurate printing operations may be enhanced.

It is a seventh object of the present invention to solve the seventh object, i.e., to simplifiy the construction of and, thereby, lower the cost of a paper feed mechanism by mounting feed rollers on a deflector through a shaft.

It is an eighth object of the present invention to solve the eighth problem, i.e., to cut down the cost of a base cover and reduce the weight of a printing device by producing the base cover by use of a sheet metal.

It is a ninth object of the present invention to solve the ninth problem, i.e., to promote shared use of a single timer.

In a printing device in which a carrier supporting a carriage which is loaded with a printing mechanism is slidably supported by a support shaft and movable along a platen to print out information, the present invention provides an improvement wherein each of the carriage and carrier is produced by pressforming a sheet metal.

The above and other objects, features and advantages of the present invention will become more apparent from the following detailed description taken with the accompanying drawings.

BRIEF DESCRIPTION OF THE DRAWINGS

FIG. 58 is a flowchart demonstrating interrupt processing which a microcomputer built in the main controller performs every 1 millisecond;

FIGS. 59A–59D are representative of a relationship between counts of the free-run counter of FIG. 58 and the elapse of time.

DESCRIPTION OF THE PREFERRED EMBODIMENTS

Various embodiments of the present invention will be described in detail with reference to the accompanying drawings.

Figure 1:
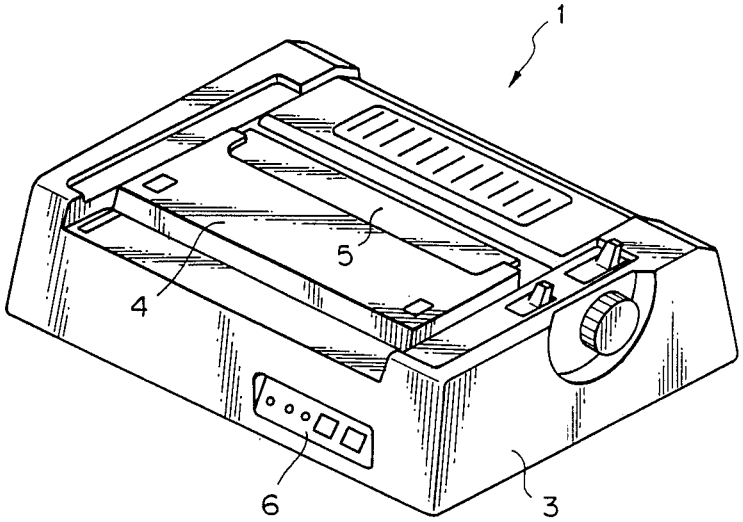
FIG. 1 is a perspective view of a printer embodying the present invention.
Figure 55:
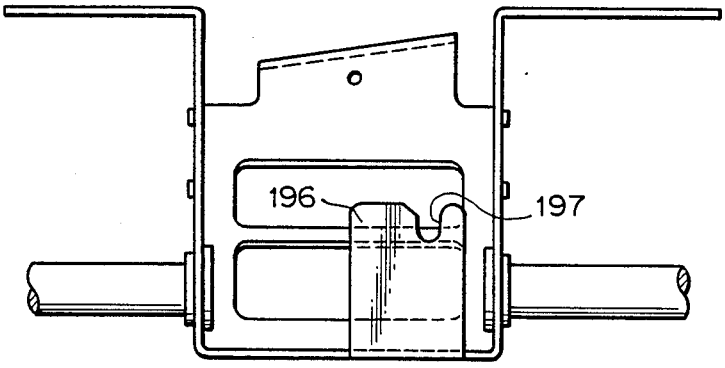
FIG. 55 is a front view representative of an embodiment in which the reference position of the carriage relative to the carrier is determined by a reference plate.

Referring to FIGS. 1 to 55, a printing device embodying the present invention is shown and generally designated by the reference numeral 1. In this particular embodiment, the printing device 1 is assumed to be a printer of the type using a type wheel by way of example.

Figure 2:
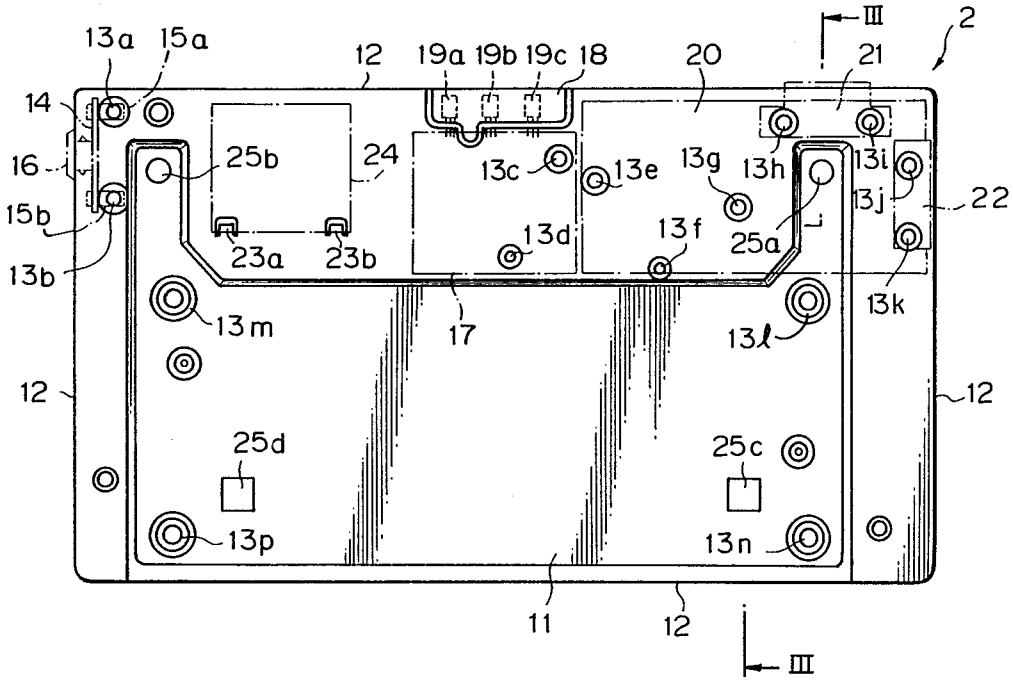
FIG. 2 is a top plan view of a base over of the printer as shown in FIG. 1.

In FIG. 1, the printer 1 has a housing which consists of a base cover 2, FIG. 2, a top cover 3 mounted on the base cover 2, a front cover 4 detachably mounted on the top cover 3, and a sound insulating cover 5 mounted on the front cover 4.

As shown in FIG. 2, the base cover 2 is produced by pressforming a sheet metal and provided with a bottom wall 11 and side walls 12. The bottom wall 11 is formed with a plurality of projections 13*a*–13*p* by contraction. A filter board 14 is fastened by screws to the projections 13*a* and 13*b* through brackets 15*a* and 15*b*, respectively. A connector 16 for connection to an AC power source is mounted on the filter board 14. While the connector 16 is received in a groove of the side wall 12 which is formed by press-forming, the brackets 15*a* and 15*b* are mounted on the filter board 14. Connected to those portions of the brackets 15*a* and 15*b* which are mounted to the filter board 14 is the ground potential of the filter board 14. Hence, the ground potential of the filter board 14 is connected to the base cover 2 via the brackets 15*a* and 15*b*, whereby the need for an extra wiring to ground is eliminated. The filter board 14 is fixed in place on the bottom wall 11 through the brackets 15*a* and 15*b*, and the connector 16 is received in the groove of the side wall 12. This allows the connector 16 to be surely fixed in place so that incomplete electrical connection between the connector 16 and the filter board 14 is prevented. The filter board 14 serves to remove externally derived power source noise.

A rectifying circuit board 17 is fastened by screws to the projections 13*c* and 13*d*. Connected to screw-threaded fastening portions of the board 17 is the ground connection of the board 17 itself. Hence, the ground potential of the board 17 is connected to the base cover 2 via the projections 13*c* and 13*d*, eliminating the need for an extra wiring to ground. The base plate 11 is also formed with a lug 18 adjacent to the board 17 by press-forming. Power transistors 19*a*, 19*b* and 19*c* which are electrically connected to the board 17 are held in contact with the lug 18 at their base portions. In this construction, heat generated in the power transistors 19*a*, 19*b* and 19*c* is transferred by the lug 18 to the base cover 2. Stated another way, the base cover 2 serves as a heat sink for the power transistors 19*a*, 19*b* and 19c, making it needless to install an extra heat sink which would add to the cost. The heat sink is applicable not only to the power transistors 19a, 19b and 19c but also to any other circuit elements which generate heat and, therefore, the lug 18 may be provided in any of suitable positions adjacent to the circuit elements.

A control circuit board 20 is fastened by screws to the projections 13e, 13f, 13g, 13h, 13i, 13j and 13k. The ground potential of the board 20 is connected to screw-threaded fastening portions of the board 20 and, therefore, to the base cover 2 via the projection 13e and others, again eliminating the need for an extra wiring to ground. An interfacing connector 21 is fastened by screws to the projections 13h and 13i and an interfacing connector 22 to the projections 13j and 13k, with the board 20 held between the connectors 21 and 22. The connectors 21 and 22, therefore, are mounted on the base cover 2 integrally with the board 20 to eliminate incomplete electrical connection thereof with the board 20.

Figure 3:
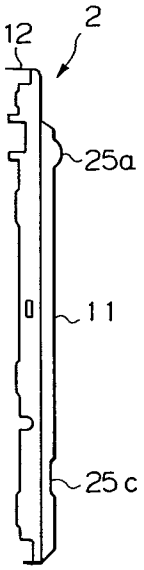
FIG. 3 is a section along line III—III of FIG. 2.
Figure 4A:
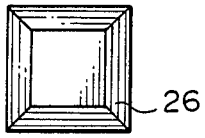
FIGS. 4A and 4B are views of rubber members which serve as legs of a base cover.
Figure 4B:
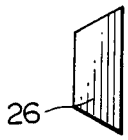

Lugs 23a and 23b extend from the bottom wall 11 to retain one end of a transformer 24 the other end of which is fastened by screws to the bottom wall 11. As shown in FIG. 3, the bottom wall 11 is provided on the back thereof a pair of projections 25a and 25b and a pair of recesses 25c and 25d. A rubber member 26, FIGS. 4A and 4B, is bonded to the walls of each of the recesses 25c and 25d. The lugs 25a and 25b and the rubber members 26 fitted in the recesses 25c and 25d serve as legs of the printer 1, the rubber members 26 preventing slippage of the printer 1. This makes it needless to use extra legs which would increase the cost.

Figure 5:
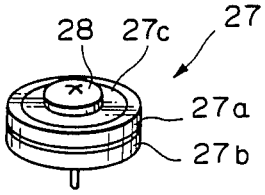
FIG. 5 is a perspective view of a retainer adapted to mount a side plate to the base cover.
Figure 6:
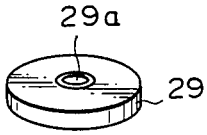
FIG. 6 is a perspective view of a cushioning rubber member of a side plate.

A retainer 27, FIG. 5, is mounted by a screw 28 to each of the projections 13l and 13m which are formed by press-forming on the bottom wall 11. As shown in FIG. 5, the retainer 27 comprises two rubber disks 27a and 27b laid one upon the other and interconnected by the screw 28 through a washer 27c. A cushioning member 29 made of rubber, FIG. 6, is bonded to each of the projections 13n and 13p of the bottom wall 11 and each is formed with an opening 29a through which a screw is to be passed. The base cover 2 which comprises a press-formed sheet metal as stated above achieves good shielding ability, readily ensures ground potential as well as a heat sink, and contributes to the cut-down of cost.

Figure 7:
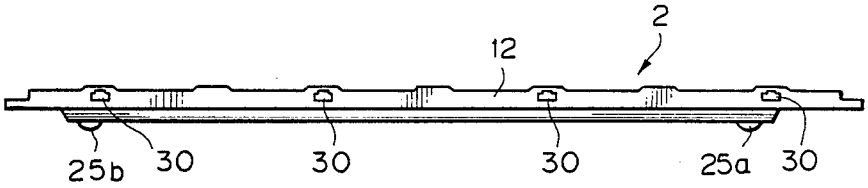
FIG. 7 is a front view of the base cover.

As shown in FIG. 7, each side wall 12 is formed with hook portions 30 at the front end side of the printer 1 by pressforming. Each of the hook portions 30 comprises a tongue which extends out from the side wall 12 and, then, bent 90 degrees upwardly. The hook portions 30 are used to mount the the cover 3 to the base cover 2, as described later in detail.

Figure 8:
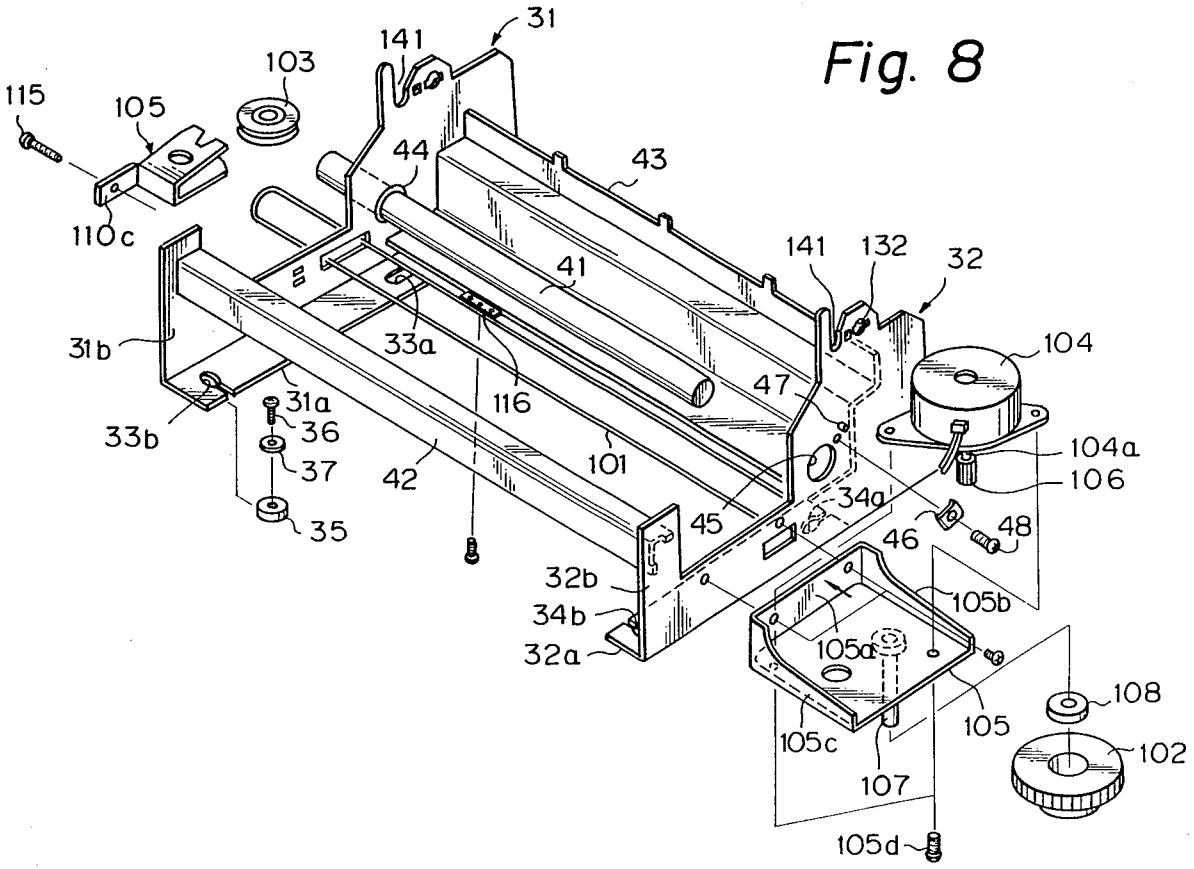
FIG. 8 is an exploded perspective view of various members which are interposed between side frames.
Figure 9:
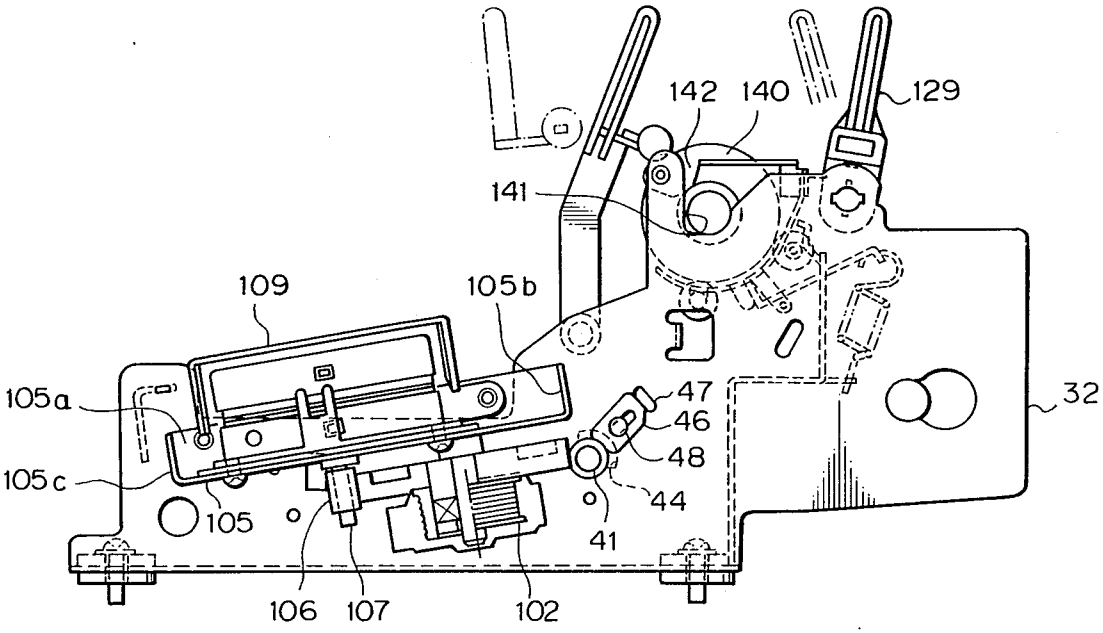
FIG. 9 is a side elevation of one of the side frames which is positioned at the right-hand side of the printer.
Figure 10:
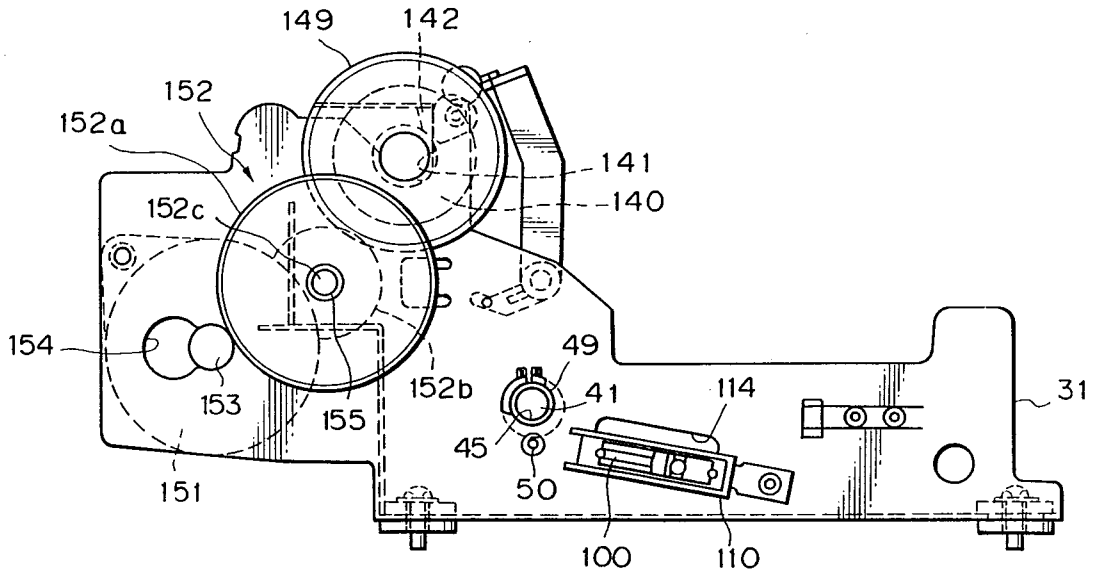
FIG. 10 is a side elevation of the other or left side frame.

Generally L-shaped side frames 31 and 32, FIGS. 8 to 10, are mounted to the retainers 27 and cushioning rubber members 29. The side frame 31 has a leg portion 31a and a wall portion 31b, and the side frame 32 a leg portion 32a and a wall portion 32b. The leg portions 31a and 32a are notched to have recesses 33a and 33b and recesses 34a and 34b, respectively. As shown, the recesses 33a and 34a extend in the longitudinal direction of the printer 1, and the recesses 33b and 34b in the lateral direction of the same and, therefore, perpendicularly to the recesses 33a and 34a. The side frame 31 is mounted to the base cover 2 by inserting that part of the leg potion 31a where the recess 33a is formed between the rubber disks 27a and 27b of the retainer 27, then attaching a cushioning rubber member 35, FIG. 8, similar to the cushioning member 29 to the leg portion 31a in alignment with the member 29, and then driving a screw 36 into the projection 13n through a washer 37, cushioning member 35, and recess 33b. The other side frame 32 is mounted to the base cover 2 by the same device and procedure as the side frame 31. This allows the side frames 31 and 32 to be readily mounted to the base cover 2 and, thereby, simplifies the assemblage of the printer 1. Consequently, efficient manipulation is enhanced and the cost is cut down.

A support shaft 41, a support rail 42 and a stay 43 extend between the side frames 31 and 32. The side frames 31 and 32 are respectively formed with openings 44 and 45 through which the support shaft 41 extends. Each of the openings 44 and 45 consists of a larger diameter portion and a smaller diameter portion. As best shown in FIG. 9, a leaf spring 46 abuts at one end against that end of the support shaft 41 which protrudes through the side frame 32 and at the other end against a stop pin 47, which protrudes from the side frame 32. The leaf spring 46 is curved at an intermediate portion thereof away from the side frame 32, the intermediate portion being urged by a screw 48 toward the side frame 32. The support shaft 41, therefore, is constantly biased toward the smaller diameter portion of the opening 44 by the leaf spring 46. Meanwhile, as shown in FIG. 10, a C-ring is fitted on that end of the support shaft 41 which protrudes through the side frame 31. The C-ring 49 is urged by a screw 50 toward the smaller diameter portion of the opening 45. In this construction, the support shaft 41 can be mounted to the side frames 31 and 32 without resorting to recesses otherwise necessarily formed by an extra step in those ends of the support shaft 41 for receiving E-rings, whereby the cost is cut down.

Figure 11:
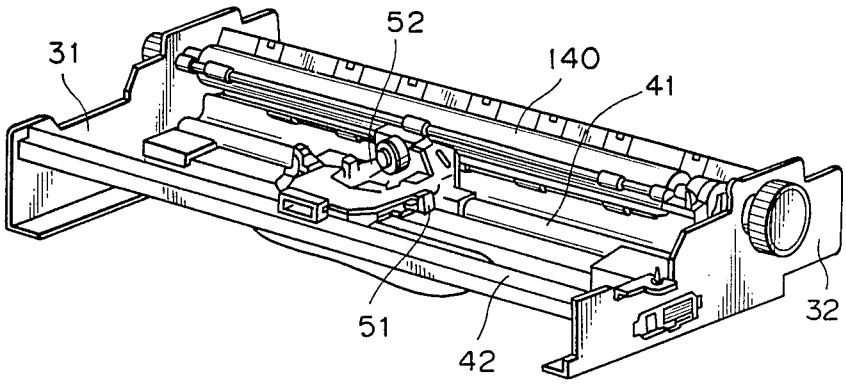
FIG. 11 is a perspective view of a printing mechanism section of the printer.
Figure 12:
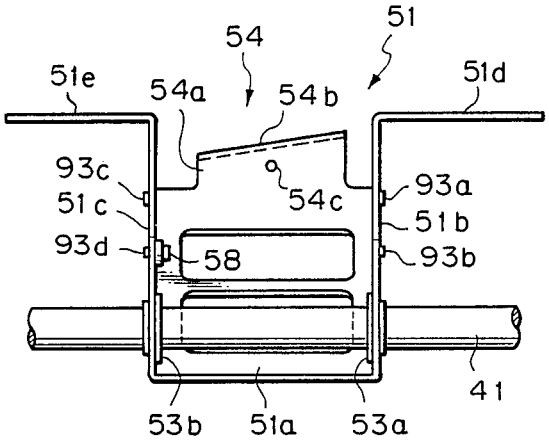
FIG. 12 is a front view of a carrier.
Figure 13:
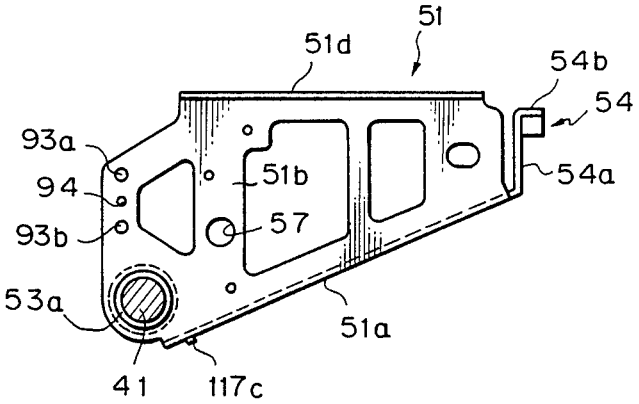
FIG. 13 is a side elevation of the carrier.
Figure 14:
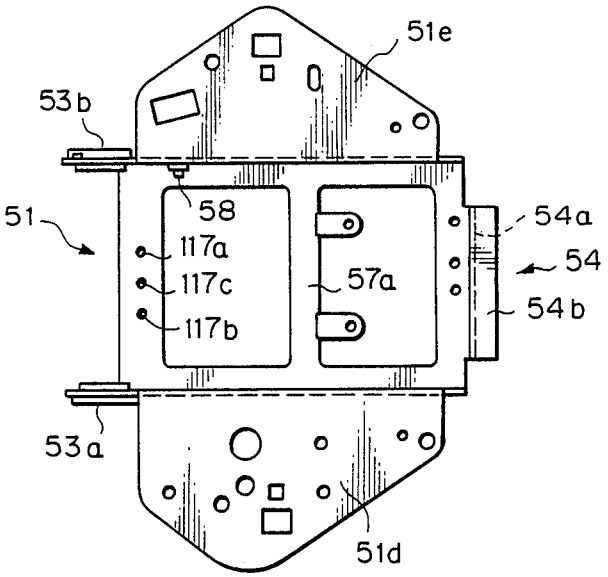
FIG. 14 is a top plan view of the carrier.

As shown in FIG. 11, a carrier 51 is slidably supported by the support shaft 41 and support rail 42. A carriage 52 is rotatably mounted on the carrier 51. The carrier 51 is produced by press-forming a single sheet metal and, as shown in FIGS. 12, 13 and 14, constituted by a bottom wall portion 51a, side wall portions 51b and 51c, and top wall portions 51d and 51e. This needs a minimum of secondary machining and, therefore, promotes cost reduction. The carrier 51 is slidably supported by the support shaft 41 through bearings 53a and 53b which are mounted on the side wall portions 51b and 51c, respectively. The rear end of the bottom wall portion 51a terminates at a guide section 54 which is made up of a vertical plate 54a and a guide plate 54b which extends from the upper end of the vertical plate 54a. The guide plate 54b is inclined at a predetermined angle in the widthwise (or lateral) direction of the carrier 51. The vertical plate 54a is formed with a threaded opening 54c.

Figure 15B:
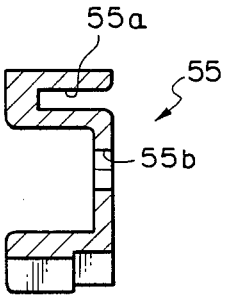
FIGS. 15A and 15B are respectively a front view and a sectional view of a slider.
Figure 15A:
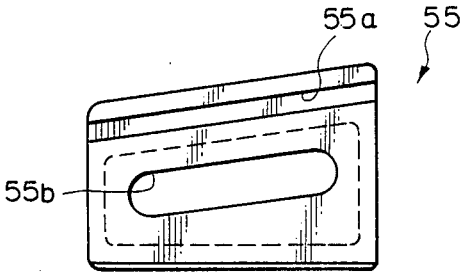

As shown in FIGS. 15A and 15B, a slider 55 having a generally U shape is mounted on the guide portion 54. The slider 55 is provided with a recess 55a which is inclined by the same angle as the guide plate 54b, and a slot 55b which extends in parallel with the recess 55a. The guide plate 54b is received in the recess 55a. The slider 55 is mounted to the guide portion 54 by inserting the guide plate 54b into the recess 55a, and then driving a screw into the threaded opening 54c through the slot 55b. The lower end of the slider 55 rests on the upper end of the support rail 42 so that the rear end of the carrier 51 is supported by the support rail 42. When the slider 55 is moved along the slot 55b relative to the guide portion 54, the rear end of the carrier 51 is moved upwardly or downwardly relative to the support rail 42 due to the inclination of the guide plate 54*b*, causing the carrier 51 to rotate about the support shaft 41.

Figure 16:
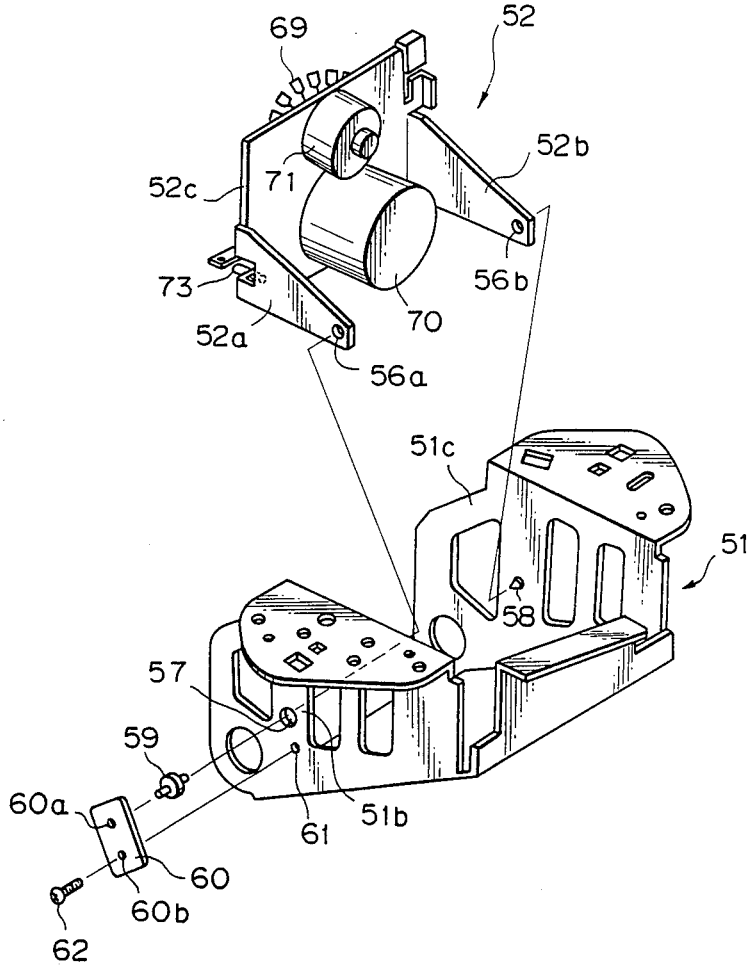
FIG. 16 is an exploded perspective view of the carrier and a carriage.

The carriage 52 is produced by press-forming a sheet metal. As shown in FIG. 16, the carriage 52 has side walls 52*a* and 52*b*, and a support plate 52*c*. The side walls 52*a* and 52*b* are formed with openings 56*a* and 56*b*, respectively. The carriage 52 is rotatably supported by the carrier 51 through pins which are inserted in the openings 56*a* and 56*b*. Specifically, as shown in FIGS. 13 and 16, the side wall 51*b* of the carrier 51 is provided with an opening 57 while, as shown in FIGS. 12, 14 and 16, the side wall 51*c* is formed with a pin 58 by contraction during the course of press-forming. This requires a minimum of secondary machining and enhances cost-effective design.

Figure 17:
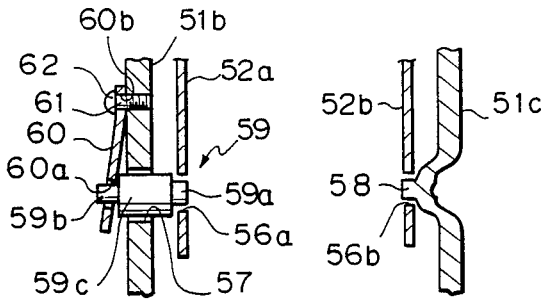
FIG. 17 is an enlarged section of those portions of the printer which are adapted to support the carrier and carriage.

The carriage 52 is mounted to the carrier 51 by the following procedure. First, the opening 56*b* of the side wall 52*b* is coupled over the pin 58 of the carrier 51 and, then, a pin 59 is inserted into the openings 57 and 56*a* of the side walls 51*b* and 52*a* of the carrier 51 and carriage 52. As shown in detail in FIG. 17, the pin 59 consists of an intermediate portion 59*c* and opposite end portions 59*a* and 59*b* which are smaller in diameter than the intermediate portion 59*c*. The smaller diameter portion 59*a* is inserted into the opening 56*a* of the carriage 52, the larger diameter portion 59*c* is inserted into the opening 57 of the carrier 51,, and the other small diameter portion 59*b* is inserted into an opening 60*a* of a leaf spring 60. The leaf spring 60 is fixed in place by driving a screw 62 into the threaded openings 60*b* and 61 of the leaf spring 60 and side wall 51*b*, respectively. In this configuration, the pin 59 is constantly urged by the leaf spring 60 toward the side wall 52*a* so that the shoulder of the pin 59 where the intermediate portion 59*c* and the end portion 59*a* join each other is abutted against the side wall 52*a* to in turn urge the carriage 52 toward the side wall 51*c*. Consequently, the carriage 52 is constantly urged toward the side wall 51*c* due to the resiliency of the leaf spring 60 and, thereby, prevented from shaking. Because the pin 58 is formed during the course of press-forming of the carrier 51, the production cost is reduced. Further, because the pin 58 has a stepped pin configuration, the side wall 52*b* is prevented from making contact with the side wall 51*c* so that the carriage 52 is rotatably supported by the pins 58 and 59.

Figure 18:
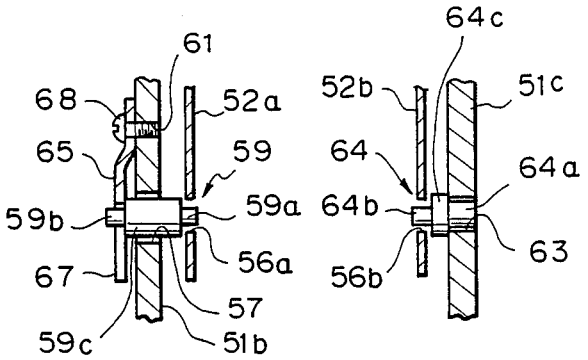
FIG. 18 is an exploded perspective view showing another example of the support structure for the carrier and carriage.
Figure 19:
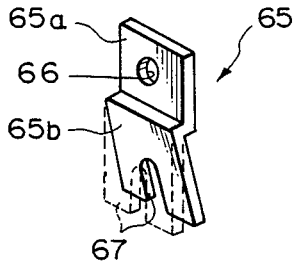
FIG. 19 is a perspective view of a leaf spring as shown in FIG. 18.

While both the carrier 51 and the carriage 52 have been shwon and described as being implemented with press-formed sheet metals, the cost reduction will be attained even if press-forming is applied to only one of them. The pin 58 and the leaf spring 60 may be replaced with those shown in FIGS. 18 and 19, if desired. Specifically, in the alternative configuration shown, the side wall 51*c* is formed with an opening 63 while one smaller diameter end 64*a* of a pin 64 is inserted into the opening 63. The other smaller diameter end 64*b* of the pin 64 is inserted into the opening 56*b* of the side wall 52*b*, an intermediate larger diameter portion 64*c* of the pin 64 preventing contact between the side walls 51*c* and 52*b*. As shown in FIG. 19, a leaf spring 65 has two flat portions 65*a* and 65*b* which are interconnected by a shoulder. The flat portion 65*a* is provided with an opening 66 and the flat portion 65*b* with an elongate recess 67 which is open at an end of the leaf spring 65. The leaf spring 65 is fixed in place by inserting the end 59*b* of the pin 64 into the recess 67 and, then, driving a screw 68 into the opening 66 and the threaded opening 61 of the side wall 51*b*. In this manner, the carriage 52 is rotatably mounted on the carrier 51 through the pins 64 and 59 while being prevented from shaking by the leaf spring 65.

Figure 20:
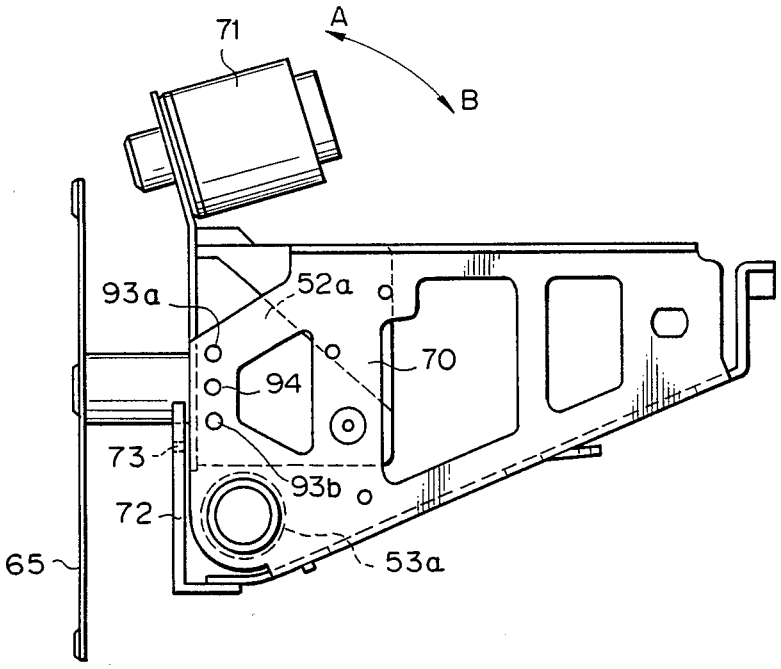
FIG. 20 is a side elevation of the carrier which is loaded with the carriage.
Figure 21:
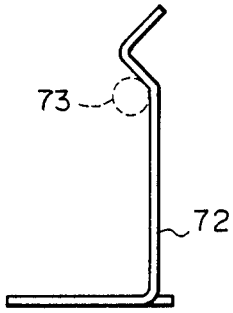
FIG. 21 is a side elevation of a catcher adapted to retain the carrier on the carriage.

As shown in FIG. 16, the carriage 52 is loaded with a type wheel 69 having fingers which are provided with type elements at their tips, a select motor 70 for rotating the type wheel 69, a hammer 71 for selectively hammering the type elements of the type wheel 69, and other printing mechanisms. As shown in FIG. 20, the carriage 52 is supported by the carrier 51 in such a manner as to be rotatable as indicated by a double headed arrow, i.e., in directions A and B. To replace the type wheel 69 with another, the carriage 52 is rotated in the direction B. After the replacement, the carriage 52 is rotated in the direction A toward a printing position at which a catcher, FIG. 21, mounted on the carrier 51 catches a catch bar 73 mounted on the carriage 52 so as to restrict further movement of the carriage 52 in the direction B.

At the printing position, the hammer 71 hammers the type elements of the type wheel 69. In this instance, the printing accuracy is effected by vertical and lateral oscillations of the carriage 52. The vertical oscillations are surely prevented by causing the side walls 52*a* and 52*b* of the carriage to abut against the bearings 53*a* and 53*b* and engaging the catcher 72 with the catch bar 73. The printing level, or height, is determined by the side walls 52*a* and 52*b* of the carriage 52 which abut against the upper ends of the bearings 53*a* and 53*b* which are mounted on the carrier 51. That is, while the printing position is determined using the upper ends of the bearings 53*a* and 53*b* as a reference, the printing position is accurate since the bearings 53*a* and 53*b* are mounted on the carrier 51 and carriage 52 both of which are produced by press-forming a sheet metal. This eliminates the need for an extra mechanism otherwise required for determining a printing level, thereby cutting down the cost. The widthwise oscillations, i.e., lateral oscillations, too, are surely prevented by the biasing force of the leaf spring 65 and the rigidity of the carriage 52 since the carriage 52 is biased by the leaf spring 65 in one direction and produced by press-forming. Thus, accurate printing and low production cost are achieved at the same time.

Figure 22A:
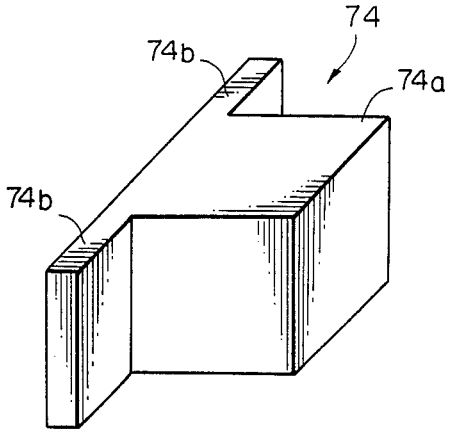
FIGS. 22A, 22B and 22C are respectively a perspective view, a bottom view and a rear view of a hammer cover.
Figure 22B:
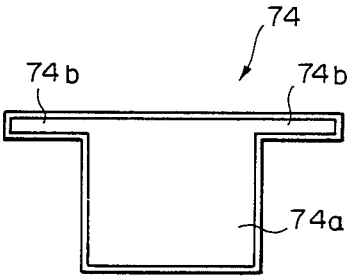
Figure 22C:
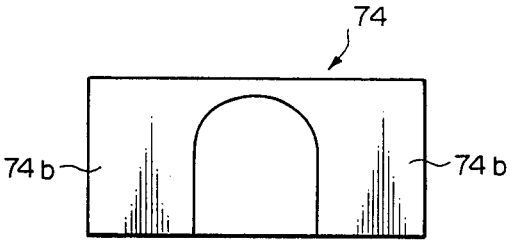

A hammer cover 74 which is constructed as shown in FIGS. 22A to 22C may be attached to the hammer 71. As shown in FIGS. 22A to 22C, the hammer cover 74 consists of a body portion 74*a* and flange portions 74*b* which extend away from each other from the body portion 74*a*. While the body portion 74*a* is attached to the hammer 71, the flange portions 74*b* are attached to the support plate 52*c* of the carriage 52 on which the hammer 71 is mounted. Made of heat-resisting resin, the hammer cover 74 may be held by hand to rotate the carriage 52. This ensures safe manipulation of the printer 1. If desired, only the body portion 74*a* of the hammer cover 74 may be produced and attached to the hammer 71.

Figure 23:
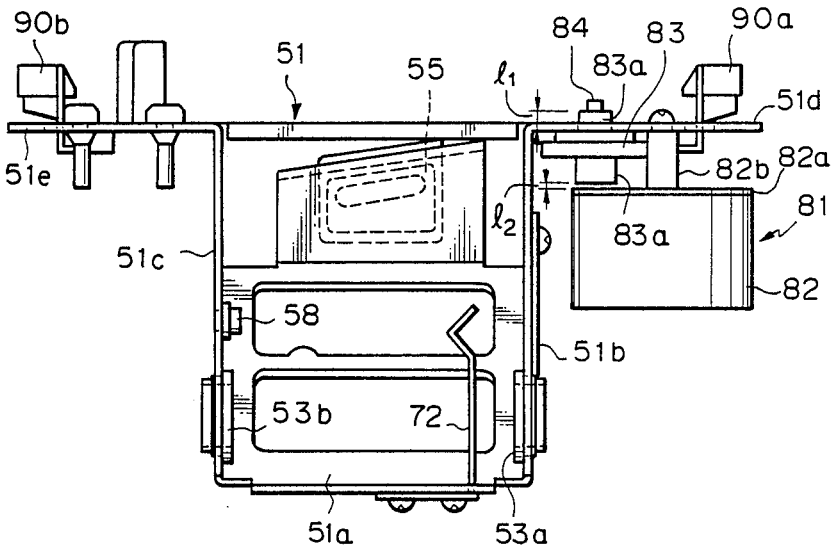
FIG. 23 is a front view of the carrier which is loaded with a ribbon feed mechanism.
Figure 24:
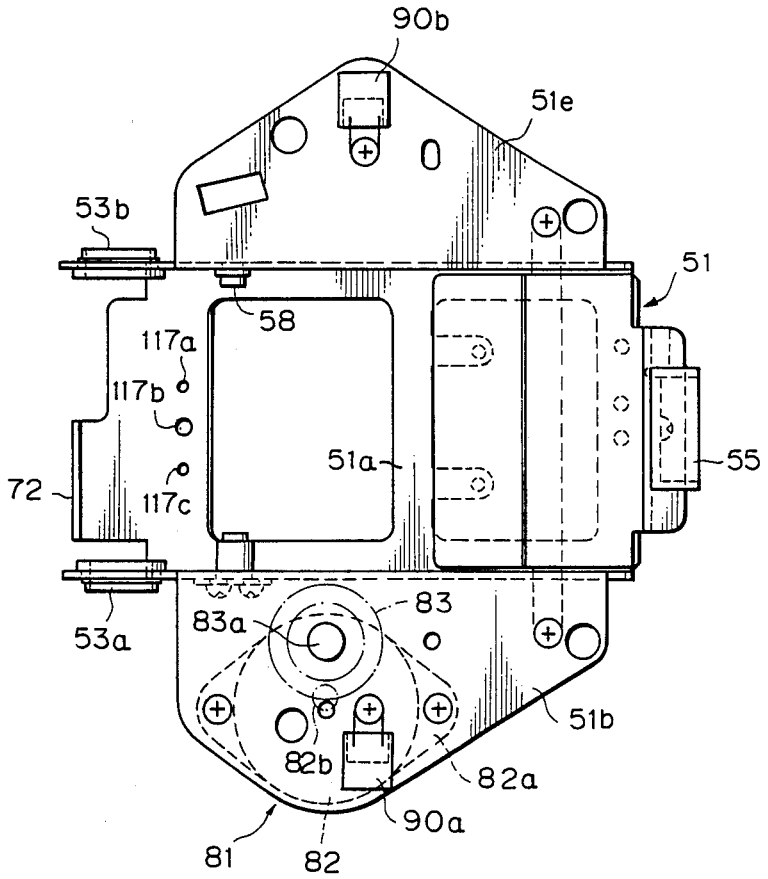
FIG. 24 is a bottom view of the arrangement of FIG. 23.
Figure 25:
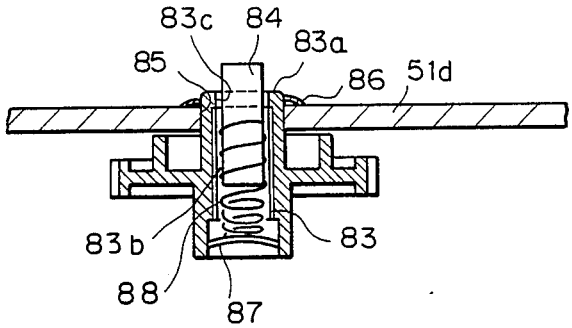
FIG. 25 is a section of a ribbon feed gear.
Figure 26:
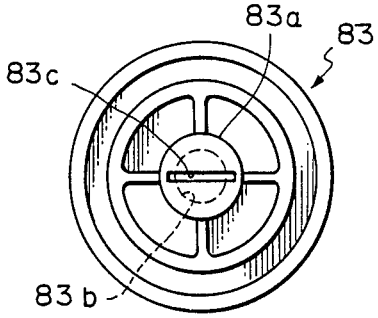
FIG. 26 is a top plan view of the ribbon feed gear.

As shown in FIGS. 23 and 24, a ribbon feed mechanism 81 is mounted on the upper wall 51*d* of the carrier 51. The ribbon feed mechanism 81 comprises a ribbon feed motor 82, a ribbon feed gear 83 rotated by the motor 82, and a drive piece 84 rotated by the feed gear 83. The motor 82 is fastened by screws to the top wall 51*d* through a flange 82*a*, a pinion 82*b* being mounted on an output shaft of the motor 82. As shown in FIG. 25, the ribbon feed gear 83 has a shaft portion 83*a* which is inserted in an opening 85 formed through the top wall 51*d*. A C-ring 86 is fitted on that end of the shaft portion 83*a* which protrudes upwardly from the top wall 51*d*, whereby the gear 83 is rotatably mounted on the top wall 51*d*. The shaft portion 83*a* is formed with a bore 83*b* and a slot 83*c* which is positioned at the top of the shaft portion 83*a* and, as shown in FIG. 26, communicated to the bore 83*b*. The drive piece 84 is slidably received in the bore 83*b*. The upper end portion of the drive piece 84 is shaped complementary to the slot 83*c* and capable of protruding through the slot 83*c* to the outside of the gear 83. A spring 88 is retained by a C-ring 87 to constantly bias the drive piece 84 upwardly.

The ribbon feed gear 83 is held in mesh with the pinion 82*b* of the ribbon feed motor 82 to be driven by the motor 82. The positional relationship between the gear 83 and the motor 82 is such that, as shown in FIG. 24, the flange 82*a* of the motor 82 is located below the shaft portion 83*a* of the gear 83 and, as shown in FIG. 23, the length $l_1$ over which the shaft portion 83*a* protrudes upwardly from the top wall 51*d* is longer than the distance $l_2$ between the lower end of the shaft portion 83*a* and the upper end of the flange 82*a*. Such dimensions prevent the gear 83 from slipping off the top wall 51*d* and maintains the shaft portion 83*a* received in the bore 83*b* even when the upper end of the shaft portion 83*a* is pressed down to an unusual level. Hence, even when subjected to unusual downward forces, the performance of the gear 83 is preserved. Because the gear 83 is mounted on the top wall 51*d* directly without the intermediary of a bearing, as stated above, the cost is reduced.

Figure 27:
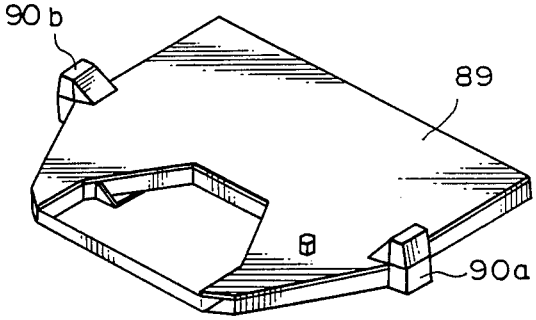
FIG. 27 is a perspective view of a ribbon cartridge.

Experiments showed that considering the durability of the printer 1 it is needless for a bearing to be used to mount the ribbon feed gear 83. A ribbon cartridge 27 such as shown in FIG. 27 is loaded on an upper portion of the carrier 51 and retained by pieces 90*a* and 90*b* which are mounted on the top walls 51*d* and 51*e*, respectively. The ribbon cartridge 89 is provided with a feed roller having a recess adapted to receive the drive piece 84. Even if the drive piece is misaligned with the recess of the feed roller in the event of loading the cartridge 89, it can be surely urged into the recess by its own rotation since it is biased by the spring 88 as previously stated.

Figure 28:
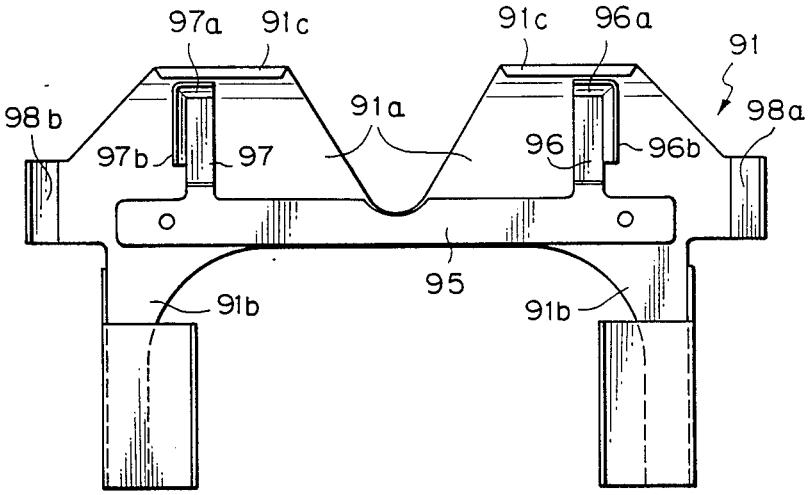
FIG. 28 is a rear view of a paper holder.
Figure 29:
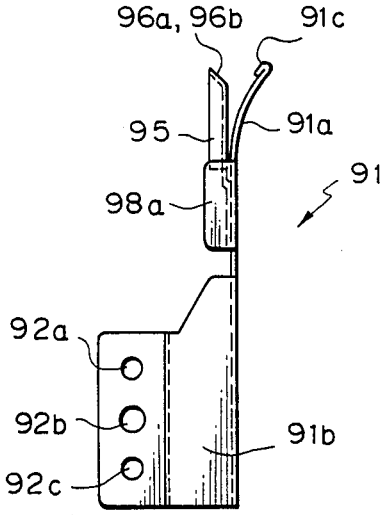
FIG. 29 is a side elevation of the paper holder.

As shown in FIGS. 28 and 29, a paper holder 91 is mounted on the carrier 51. The paper holder 91 is produced by pressforming a stainless steel sheet and includes a paper pressing portion 91*a* and an arm portion 91*b*. The paper pressing portion 91*a* is curved complementary to the curved surface of a platen, which will be described, and turned over at its upper end 91*c*. Specifically, the upper end 91*c* of the pressing portion 91*a* is turned over toward the back (opposite to a paper pressing surface). A paper, therefore, can be guided by the portion 91*a* smoothly along the platen without being caught by the upper end of the portion 91*a*. As shown in FIG. 29, the arm portion 91*b* is provided with three openings 92*a*, 92*b* and 92*c*. The paper holder 91 is mounted to the carrier 51 by mating the openings 92*a*, 92*b* and 93*c* with lugs 93*a*, 93*b* and 93*c* which extend from the outer surfaces of the side walls 51*b* and 51*c* of the carrier 51, as shown in FIGS. 12, 13 and 20, and then driving screws through the openings 92*b* into threaded openings 94 which are formed in the side walls 51*b* and 51*c*. Such a construction allows the paper holder 91 to be mounted and dismounted with ease from the side of the carrier 51 for cleaning purpose.

As shown in FIG. 28, a ribbon guide 95 is mounted on the paper holder 91 by spot welding. The ribbon guide 95, like the paper holder 91, is produced by press-forming a stainless steel sheet. The ribbon guide 95 is provided with ribbon guide arms 96 and 97. The ribbon guide arm 96 is provided with folded portions 96*a* and 96*b* at its top and outer side edge, respectively. Likewise, the ribbon guide arm 97 is provided with folded portions 97*a* and 97*b* at its top and outer side edge, respectively. All of these folded portions of the arms 96 and 97 are bent away from the ribbon guide 95. This promotes easy insertion of an ink ribbon from above into between the ribbon guide 95 and the ribbon guide arms 96 and 97 and, when the ink ribbon is fed, prevents it from being caught by the outer side edges of the ribbon guide arms 96 and 97, thereby ensuring smooth setting and feed of the ink ribbon. Both ends of the paper pressing portion 91*a* are turned over toward the back as at 98*a* and 98*b* so that during transverse strokes of the carrier 51 the paper pressing portion 91*a* may be prevented from catching the paper and, in addition, ink of the ink ribbon may be prevented from being scattered toward the paper.

Figure 30:
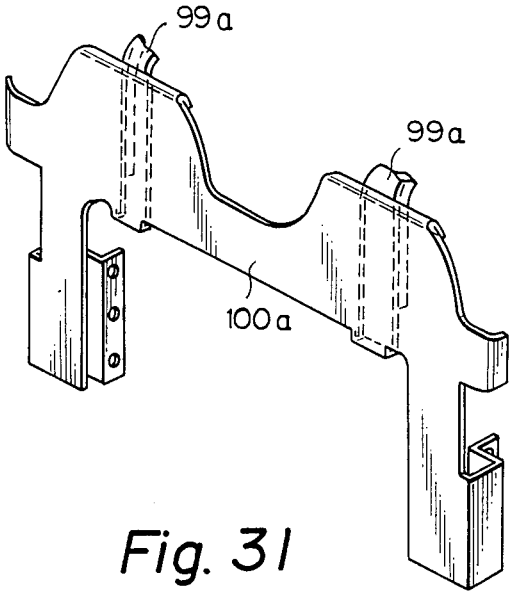
FIG. 30 is a perspective view showing another example of the paper holder.
Figure 31:
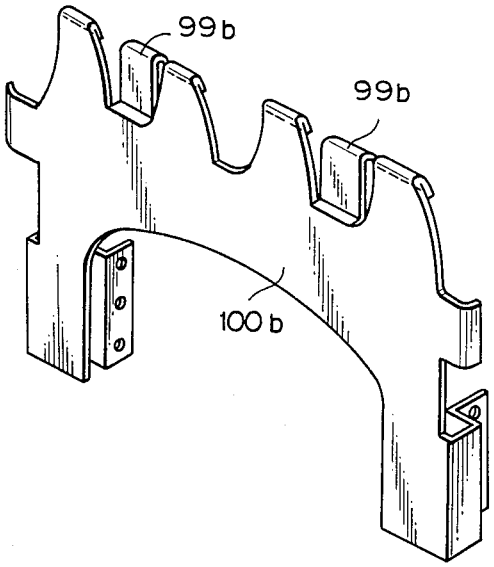
FIG. 31 is a perspective view showing still another example o the paper holder.

As shown in FIGS. 30 and 31, the ink ribbon guide may be formed integrally with the paper holder by press-forming. Specifically, the alternative procedure comprises the steps of stamping out ribbon guides 99*a* and 99*b* together with paper holders 100*a* and 100*b* and, then, bending the paper holders 100*a* and 100*b* by 180 degrees relative to the paper holders 100*a* and 200*b*. In this case, too, the upper edges and outer side edges of the ribbon guides 99*a* and 99*b* are turned over to enhance smooth ribbon feed and, further, the upper ends of the paper holders 100*a* and 100*b* are turned over to promote smooth paper feed.

Figure 32:
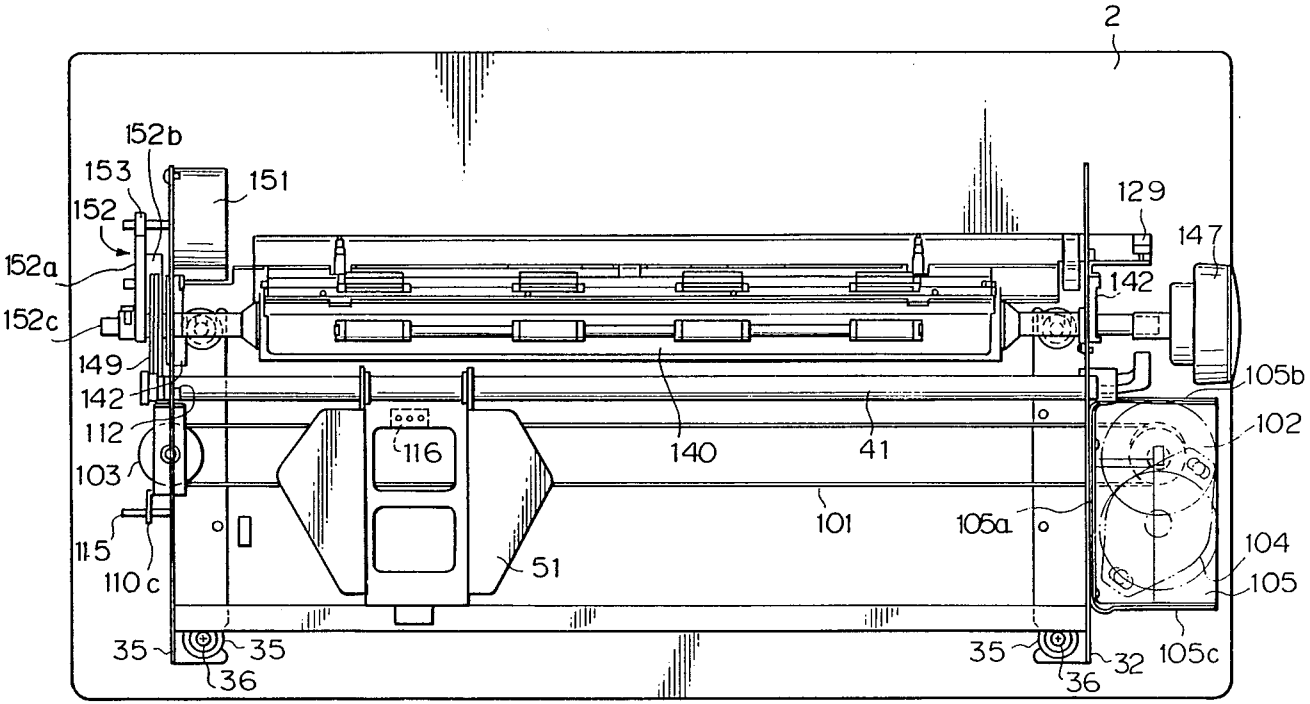
FIG. 32 is a top plan view of the base cover which is loaded with the printing mechanism section.

As shown in FIG. 32, the carrier 51 is connected to a space wire 101 to be moved thereby along the support shaft 41 and support rail 42. The space wire 101 is guided by a gear pulley 102 and a side pulley 103 and driven by a space motor 104 via the gear pulley 102. Comprising a flat motor, the space motor 104 is mounted on a bracket 105 in such an orientation that an output shaft thereof extends in a substantially vertical direction of the printer 1. This reduces the overall height of the printer 1, compared to a prior art printer having a flat motor whose output shaft extends horizontally. The bracket 105 is produced by press-forming a sheet metal and, as shown in FIG. 8, bent at three edges to form walls 105*a*, 105*b* and 105*c*. When the wall 105*a* is mounted on the side frame 82, the other walls 105*b* and 105*c* become positioned at both sides of that part of the bracket 105 which is mounted on the side frame 32. This enhances rigidity of the bracket 105 against bending forces which may be applied vertically to the bracket 105. A pinion 106 is mounted on an output shaft 104*a* of the space motor 104. A shaft 107 is mounted on the bracket 105 by crimping while a gear pulley 102 is mounted on the shaft 107 through a bearing 108.

Figure 33:
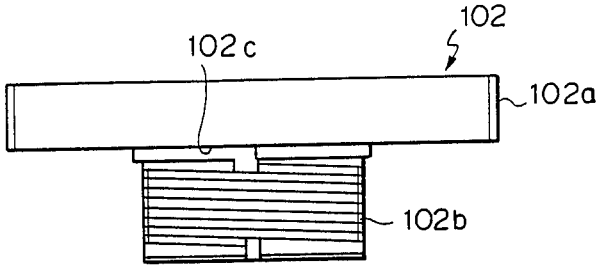
FIG. 33 is a side elevation of a gear pulley.
Figure 34:
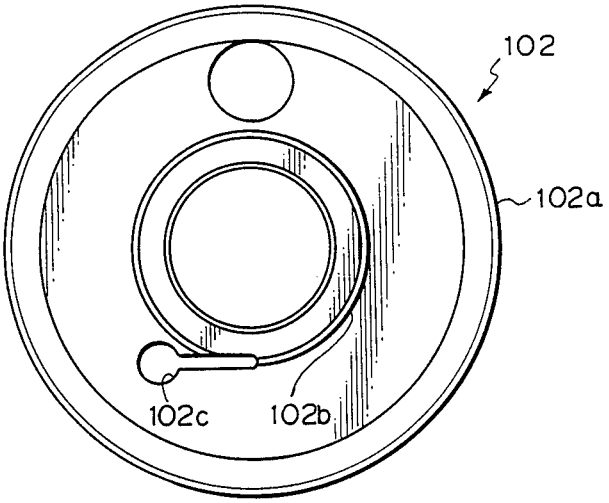
FIG. 34 is a top plan view of the gear pulley.
Figure 35:
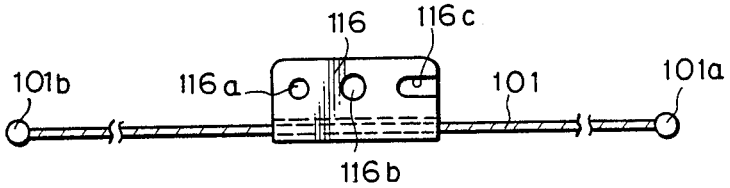
FIG. 35 is a front view of a space wire and a fixing plate which is fixed to the wire.
Figure 36A:
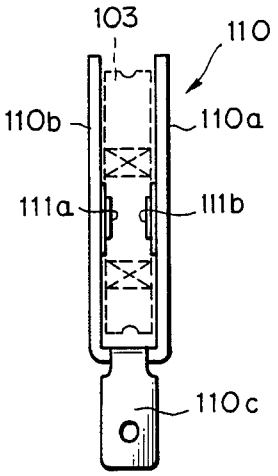
FIGS. 36A and 36B are respectively a front view and a top plan view of a bracket of a side pulley.
Figure 36B:
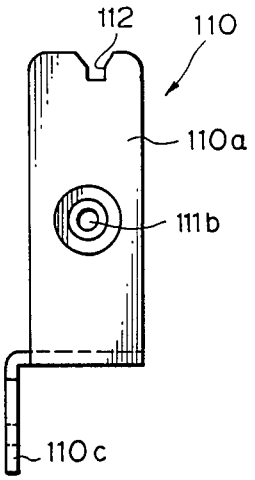

As shown in FIG. 33, the gear pulley 102 is provided with a toothed portion 102*a* which meshes with the pinion 106 and a lead portion 102*b* around which the space wire 101 is wrapped. As shown in FIG. 34, the gear pulley 102 is provided with a slot 102, in which the ends of the space wire 101 are received. As shown in FIG. 35, balls 101*a* and 101*b* are fixed to both ends of the space wire 101 so that when the wire 101 is inserted into the slot 102*c* of the gear pulley 102 they lock the wire 101 to the slot 102*c*.

As shown in FIG. 9, a motor cover 109 is mounted on the space motor 104 for safety purpose. While the walls 105*b* and 105*c* have been shown and described as being bent toward the space motor 104, they may be bent toward the gear pulley 102. In such a case, when the bracket 105 is urged toward the gear pulley 102 by the tension of the space wire 101 which is applied to the gear pulley 102, the walls 105*b* and 105*c* are brought into contact with the side frame 32 to further increase the rigidity of the bracket 105.

A side pulley 103 is mounted on the side frame 31. Specifically, as shown in FIGS. 8, 10 and 32, the side pulley 103 is rotatably mounted on a bracket 110 which is produced by press-forming a sheet metal. As shown, the bracket 110 includes two parallel arm portions 110*a* and 110*b* and a support portion 110*c*. Each of the arm portions 110*a* and 110*b* is provided with projections 111*a* and 111*b* which extend inwardly toward each other. The projections 111*a* and 111*b* are formed by contraction during the course of press-forming the bracket 110 and each in a two-step configuration. The side pulley 103 is rotatably supported between the projections 111*a* and 111*b*. The arms 110*a* and 110*b* are formed at their upper ends with a recess 112 each. The support portion 110*c*, on the other hand, is formed with a threaded opening 113.

Figure 37:
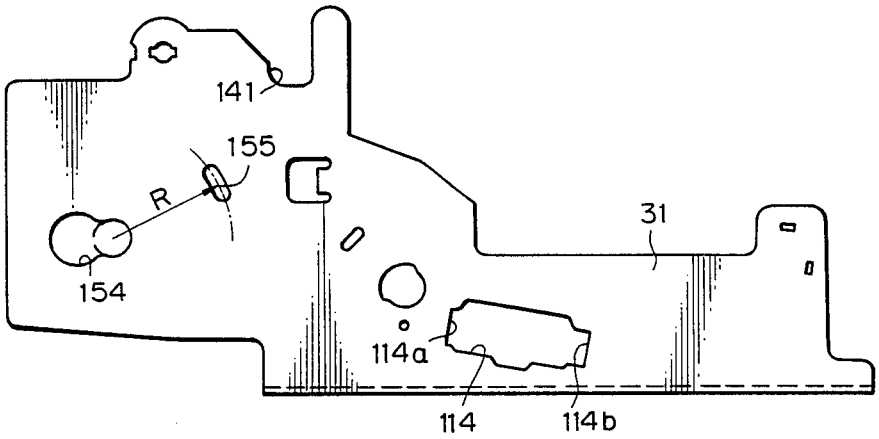
FIG. 37 is a side elevation of the left side frame.

As shown in FIG. 37, the side frame 31 is provided with a slot 114 for mounting the side pulley 103. The slot 114 includes comparatively narrow portions 114*a* and 114*b* at both ends with respect to the longitudinal direction of the printer 1. To mount the bracket 110 to the side frame 31, the tips of the arm portions 110*a* and 110*b* of the bracket 110 are inserted into the rear narrower portion 114*a* of the slot 114, then the side frame 31 of the narrower portion 114*a* is inserted into the recesses 112 of the arm portions 110*a* and 110*b*, then an adjusting screw which is shown in FIGS. 8 and 32 is driven into the threaded opening 113 of the support portion 110*c*, and then the tip of the adjusting screw 115 is brought into abutment against the side frame 31. In this construction, although the arm portions 110*a* and 110*b* of the bracket 110 are urged away from each other when the side pulley 103 is to be mounted to the bracket 110, they become retained by the side frame 31, which constitutes the narrower portion 114*a* of the slot 114, when the bracket 110 is mounted on the bracket 110. As a result, the side pulley 103 is rotatably supported by the bracket 110. Further, although the adjusting screw 115 is simply abutted against the side frame 31, the bracket 110 is surely retained by the side frame 31 since it is biased toward the side frame 31 by the tension of the space wire 101. the bracket 110 which is produced by press-forming a sheet metal contributes a great deal to the cut-down of cost.

The space wire 101 is wrapped around the lead potion 102*b* with the balls 101*a* and 101*b* thereof inserted in and caught by the slot 102*c* of the gear pulley 102, while being stretched between the gear pulley 102 and the side pulley 103. The tension of the space wire 101 is adjusted by manipulating the adjusting screw 115. The carrier 51 is connected to the space wire 101. The prior art system for the connection of the carrier and the space wire which uses a fixing plate is disadvantageous for the reasons as previously discussed. In this particular embodiment of the present invention, paying attention to the fact that the position where the carrier 51 is to be connected to the space wire 101 is determined so long as the position where the space wire 101 is connected to the gear pulley 102 is fixed, the space wire 101 is connected to the gear pulley 102 after inserting the balls 101*a* and 101*b* of the wire 101 into the lead portion 102 of the gear pulley 102 and, therefore, the mounting position of the space wire 101 to the gear pulley 102 is constant. As shown in FIG. 35, a fixing plate 116 is mounted on the space wire 101 beforehand at a predetermined position of the latter and fixed to the carrier 51 afterward. Specifically, the fixing plate 116 is provided with two openings 116*a* and 116*b* and an elongated recess 116*c* while, as shown in FIGS. 13 and 14, the carrier 51 is formed with two threaded openings 117*a* and 117*b* and a downwardly extending lug 117*c*. The fixing plate 116 is fixed by crimping to the space wire 101 at a point of predetermined length of the latter as measured from the inner side of each of the balls 101*a* and 101*b*. The opening 116*b* of the fixing plate 116 is mated with the lug 117*c* of the carrier 51. Then, screws which are passed through the openings 116*a* and 116*c* are driven into the threaded openings 117*a* and 117*b*, respectively, thereby fixing the plate 116 to the carrier 51 and, thereby, the space wire 101 to the carrier 51. In this manner, the space wire 101 and the carrier 51 are interconnected with ease to enhance efficient assemblage. In addition, because the plate 116 is mounted to the space wire 101 beforehand with extreme positional accuracy, the carrier 51 can be mounted accurately to the space wire 101

Figure 38:
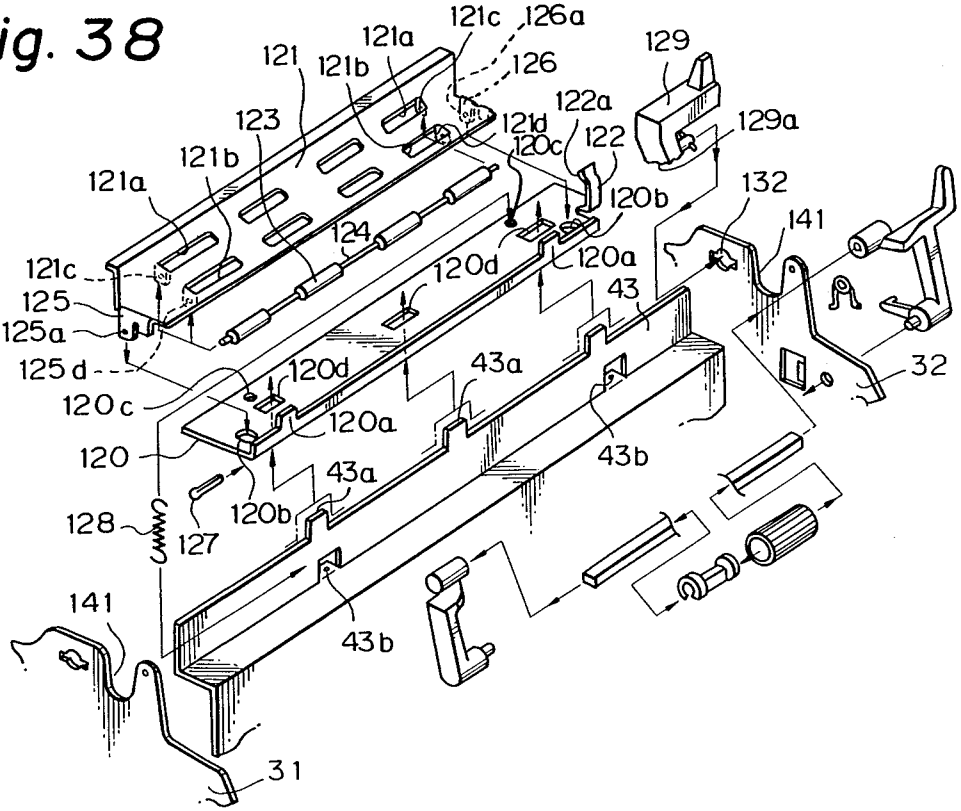
FIG. 38 is an exploded perspective view of a paper feed mechanism.

Referring to FIG. 38, a paper feed mechanism 119 is shown. The mechanism 119 includes the stay 43 extending between the side frames 31 and 32 as previously stated, a support plate 120 rotatably supported by the stay 43, a deflector 121 rotatably supported by the support plate 120, and feed rollers 123 mounted on the deflector 121 through a shaft 124. The stay 43 is provided with three lugs 43*a* at an upper end thereof and two lugs 43*b* which protrude toward the back. The support plate 120 is bent upwardly at its front end, and two lugs 120 extend from the top of the upwardly bent portion. The support plate 120 is formed with two openings 120*b* adjacent to the upwardly bent portion. The rear end portion of the support plate 120 is bent downwardly and formed with two openings 120*c*. Further, an intermediate portion of the support plate 120 is formed with three slots 120*d* which are aligned with each other in the lengthwise direction of the plate 120. The lugs 43*a* of the stay 43 are received one in each of the slots 120*d*. An arm 122 extends from that side edge of the support plate 120 which neighbors the side frame 32, the arm 122 being bent upwardly by 90 degrees relative to the support plate 120. The arm 122 is provided with a generally V-shaped bent 122*a* at its tip.

Figure 39A:
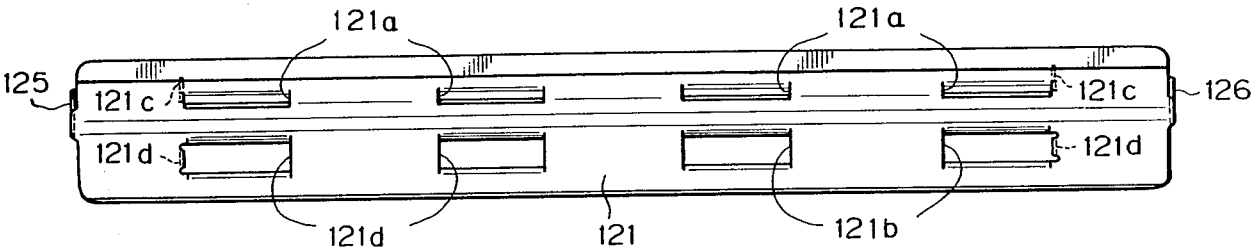
FIGS. 39A and 39B are respectively a front view and a sectional view of a deflector.
Figure 39B:
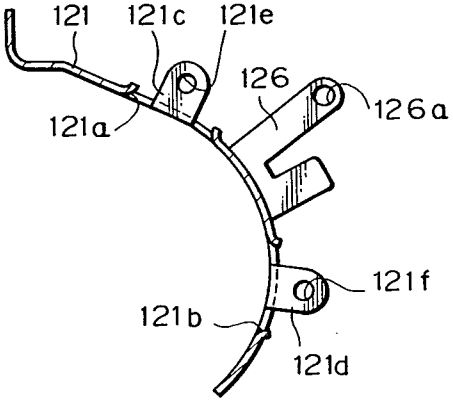

As shown in FIGS. 39A and 39B, the deflector 121 is curved complementary to the curved outer periphery of the platen. Two parallel arrays of aligned slots 121*a* and 121*b* are formed through the deflector 121. Those slots 121*a* and 121*b* which are positioned at both ends of the respective arrays are provided with brackets 121*c* and 121*d*, respectively, while the brackets 121*c* and 121*d* are formed with openings 121*e* and 121*f*, respectively. The shaft 124 which carries the feed rollers 123 therewith as shown in FIG. 38 is received in the openings 121*e* and 121*f*. The feed rollers 123 are positioned such that they are respectively matched with the slots 121*a* and 121*b* when the shaft 124 is fitted to the brackets 121*c* and 121*d*. In an assembled condition, the feed rollers 123 protrude into the curved inner periphery of the deflector 121. As shown in FIG. 39B, the opposite ends of the deflector 121 with respect to an intended direction of rotation of the platen are bent outwardly to allow a paper to be fed smoothly without being caught by the deflector 121.

Further, the deflector 121 is provided with bifurcated arms 125 and 126 at both ends thereof. Each of the bifurcated arms 125 and 126 is formed with an opening 125*a* or 126*a* through an end portion of either one of two fingers thereof, as shown in FIG. 38. The arms 125 and 126 are bent away from the curved surface of the deflector 121. The deflector 121 is mounted on the support plate 120 such that the arms 125 and 126 straddle the front bent portion of the support plate 120, those fingers of the arms 125 and 126 which are provided with the openings 125*a* and 126*a* being inserted into the slots 120*d*. A pin 127 is passed through the openings 125*a* and 126*a* of the arms 125 and 126, which are passed through the slots 120*d*, so as to mount the deflector 121 to the support plate 120. The support plate 120 is mounted to the stay 43 by inserting the lugs 43*a* into the openings 120*c*, then anchoring one end of a spring 128 to the opening 120*b* and the other end to the lug 43*b*, and then causing an operating surface 129*a* of a release lever 129 to abut against the slot 122*a* of the arm 122. Such a construction allows a person to readily clean the deflector 121 since the deflector 121, feed rollers 123, support plate 120 and stay 43 remain joined with each other.

Figure 40:
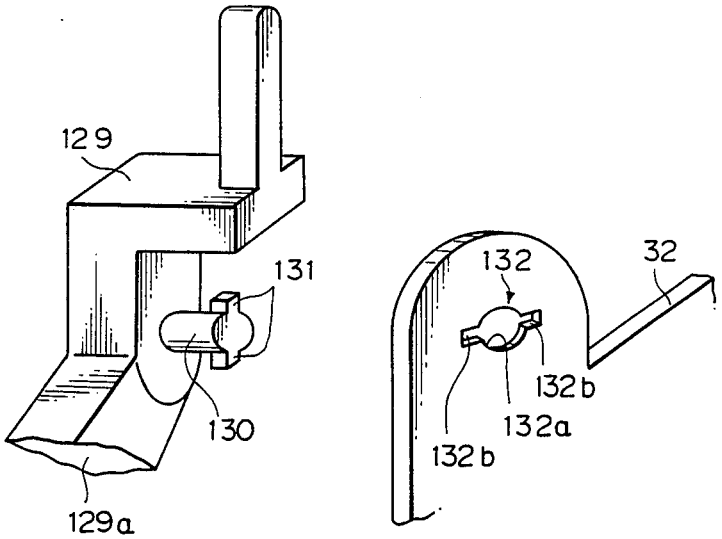
FIG. 40 is a perspective view of a release lever.

As shown in FIG. 40, the release lever 129 includes a cylindrical stub 130 which extends from a body of the lever 129, and ribs 131 which extend from the stub 130 perpendicularly to the stub 130 and symmetrically to each other. The operating surface 129*a* of the release lever 129 is undulated, as shown in FIG. 40. The side frame 32 is formed with a bearing hole 132 which consists of a circular portion 132*a* for receiving the stub 130 of the release lever 129, and slot portions 132*b* contiguous with the circular portion 132*a* for receiving the ribs 131. The slot portions 132*b* extend in the longitudinal direction of the printer 1. To mount the release lever 129 to the side frame 32, it is inclined to a horizontal position to have the ribs 131 aligned with the slot portions 132*b* of the bearing hole 132 and, then, the ribs 131 are inserted into the bearing hole 132. Thereafter, the release lever 129 is restored to its vertical position to urge the operating surface 129*a* against the lug 122*a* of the arm 122. The release lever 129, therefore, can be mounted to the side frame 32 with ease and, after the assemblage, it is prevented from slipping off by the ribs 131. Stated another way, the release lever 129 can be mounted with ease and there is no need for an E-ring and secondary machining for forming a groove adapted to receive the E-ring, whereby the production cost is cut down.

As the release lever 129 is tilted rearwardly of the printer 1, the support plate 120 is rotated about the stay 43 with the result that the front end, i.e., the lugs 120*a* of the plate 120 are lowered to in turn lower the deflector 121 away from the platen. When the release lever 129 is tilted forwardly, on the other hand, the lugs 120*a* are raised to move the deflector 121 upwardly toward the platen. As described, the printer 1 does not need an arm heretofore used to support a shaft on which feed rollers are mounted, that is, it allows the deflector 121 and the feed roller 123 to move up and down integrally with each other by a simple construction, again cutting down the cost.

As shown in FIGS. 9, 10, 11 and 32, the platen 140 extends along the deflector 121. Specifically, the platen 140 are inserted in bearing recesses 141 which are formed one in each of the side frames 31 and 32. Latch levers 142 prevent the platen 142 from slipping off the bearing recesses 141. When the release lever 129 is manually operated, the deflector 121 is brought into or out of contact with the platen 140 together with the feed rollers 123. Because the lugs 120*a* of the support plate 120 supports the deflector 12 between the two shafts and such that the deflector 121 is free to rotate, upon contact of the feed roller 123 with the platen 140 the deflector 121 is rotated along the curved periphery of the platen 140 with the result that the feed rollers 123 fitted in the slots 121*c* and those fitted in the brackets 121*d* are urged against the platen 140 by a same pressure force. Hence, a paper wrapped around the platen 140 is fed smoothly without twisting, jamming and other undesirable occurrences.

Figure 41:
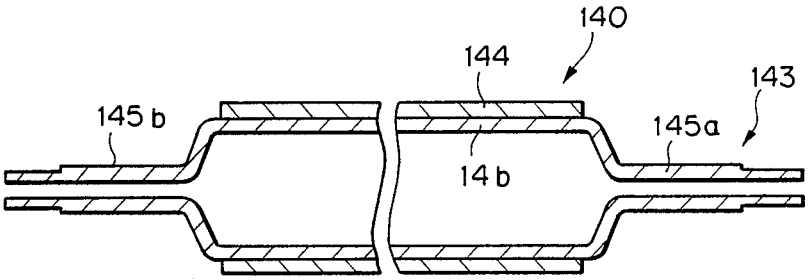
FIG. 41 is a section of a platen.

As shown in FIG. 41, the platen 140 comprises a tubular body 143 and an elastic member 144. The tubular body 143 is produced by swaging both ends of a tube which is made of aluminum or aluminum alloy, the swaged ends constituting shaft portions 145*a* and 145*b*. The elastic member 144, on the other hand, comprises a protrusion-molded rubber tube which is press-fitted on the outer periphery of an intermediate portion 146 of the meal tube 143 and, then, polished. Such surface treatment of the rubber tube 144 is performed by rotating the platen assembly while supporting the shaft portions 145*a* and 145*b*. This not only provides the rubber tube 144 with a smooth surface but also readily makes the rubber tube 144 with the shaft portions 145*a* and 145*b* coaxial with each other.

The shaft portion 145*a* is provided with a notch 148 at an end portion thereof for mounting a platen knob 147, FIG. 32, on the shaft portion 145*a*. The other shaft portion 145*b* is provided with a notch 150 at an end portion thereof for mounting a platen gear 149, FIGS. 10 and 32. These notches 148 and 150 are formed during the course of the swaging step. Because the platen 140 is made up of the swaged metal tube 143 and the rubber tube 144, not only accurate alignment of axes is achieved but also the ease of production is promoted to reduce the cost. Further, because the metal tube 143 is made of aluminum or like material, the platen 140 as a whole is lightweight so that the line feed motor 151, FIGS. 10 and 32, adapted to drive the platen 140 does not have to be of a large output type which would add to the cost of the printer 1.

If desired, the swaging step stated above may be such that the diameter of the platen 140 is reduced in a plurality of consecutive steps, i.e., not in a single sharp step in order to cause the intermediate portion 146 to merge into the shaft portions 145*a* and 145*b* with a certain angle of inclination. Such an alternative swaging step would enhance the rigidity of those portions of the platen 140 which lie between the intermediate portion 146 and the shaft portions 145*a* and 145*b*, thereby promoting the use of a thinner tubular body 143 than in the case of single-step diameter reduction.

As shown in FIGS. 10 and 32, when the platen 140 is supported by the side frames 31 and 32, the platen gear 149 is operatively connected to a motor gear 153 by an idle gear 152. As previously stated, the motor gear 153 is mounted on the shaft of the line feed motor 151. Mounted on the inner surface of the side frame 31, the line feed motor 151 has an output shaft protruding outwardly from the side frame 31. Specifically, as shown in FIG. 37, side frame 31 is formed with an opening 154 which is made up of a larger diameter portion and a smaller diameter portion. The line feed motor 151 is mounted to the side frame 31 by inserting the motor gear 153 into the larger diameter portion of the opening 154 and disposing the shaft of the motor 151 in the smaller diameter portion of the same. As shown in FIGS. 10 and 32, the idle gear 152 consists of a first gear 152*a* and second gear 152*a* which has a smaller diameter and a smaller number of teeth than the first gear 152*a*. The first or larger diameter gear 152*a* is meshed with the motor gear 153, and the second or smaller diameter gear 152*b* with the platen gear 149. Here, what is important for the platen 140 to be indexed by a constant amount and, therefore, for the printing accuracy to be enhanced is adequately adjusting the intermesh of the gears 152*a* and 153 and that of the gears 152*b* and 149.

In light of the above, as shown in FIGS. 10 and 37, the printer 1 in accordance with this particular embodiment fixes a shaft 152*c* of the idle gear 152 at a particular position where the backlash between the idle gear 152 and the platen gear 149 becomes adequate, by inserting the shaft 152*c* into an arcuate slot 155 of a radius R which is formed through the side frame 31 with the center thereof defined by the opening 154. In detail, the number of teeth of the motor gear 153 is smaller than that of the smaller diameter gear 152*a* while the number of teeth of the larger diameter gear 152*a* which is in mesh with the motor gear 153 is greater than that of the platen gear 149. It follows that the backlash between the gears 152*b* and 149 has greater influence on the rotation of the platen 140 than the backlash between the gears 153 and 152*a*. This will account for the above-stated particular arrangement for fixing the shaft 152*c* of the idle gear 152. The backlash between the motor gear 153 and the larger diameter gear 152*a*, on the other hand, is adequately set up since the shaft 152*c* of the idle gear 152 is movable within and along the arcuate slot 155. Therefore, all that is required during assemblage is setting up adequate backlash between the gears 152*b* and 149. This enhances accurate printing and promotes the case of assemblage.

Turning back to FIG. 1, the top cover 3 of the printer 1 is mounted on the base cover 2, as previously described. Specifically, as shown in FIG. 7, the base cover 2 is provided with the lugs, or hooks, 30 on the front wall 12 thereof and threaded openings, not shown, in the rear wall 12. The top cover 3, on the other hand, is provided with hook receiving portions 161 in a front wall thereof and threaded openings 162 in a rear wall thereof. To mount the top cover 3 to the base cover 2, the hook receiving portions 161 of the top cover 3 are mated with the hooks 30 of the base cover 2 and, then, screws are driven into the threaded openings 162 of the top cover 3. The top cover fully conceals the walls 12 of the base cover 2 so that the base cover 2 is not visible from outside. This implies that the printer 1 has attractive appearance despite the use of the base cover 2 which is implemented with a sheet metal.

Figure 42:
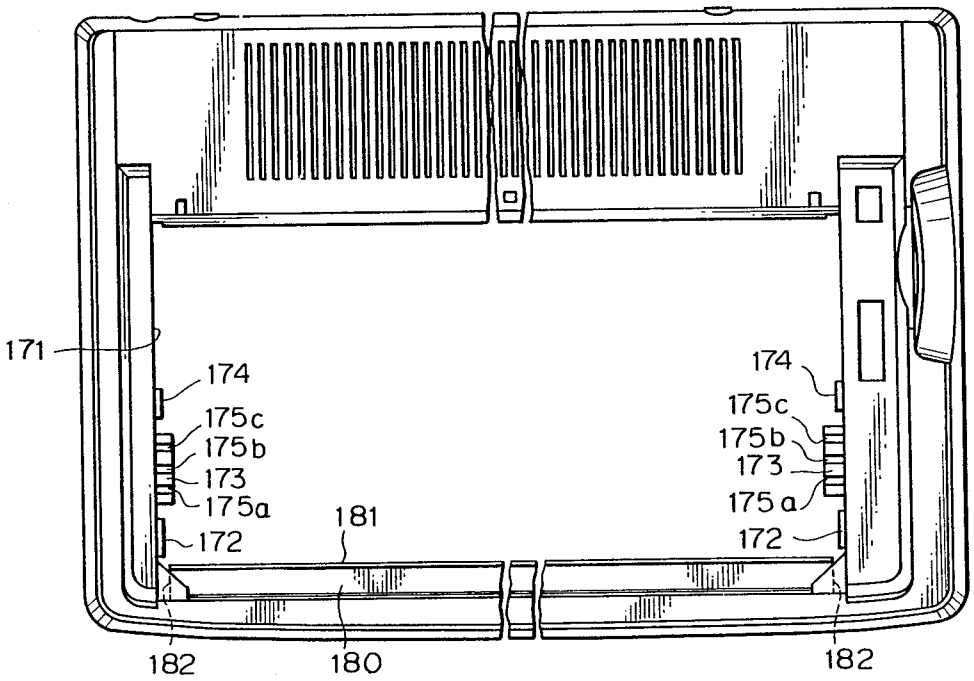
FIG. 42 is a top plan view of a top cover.
Figure 43:
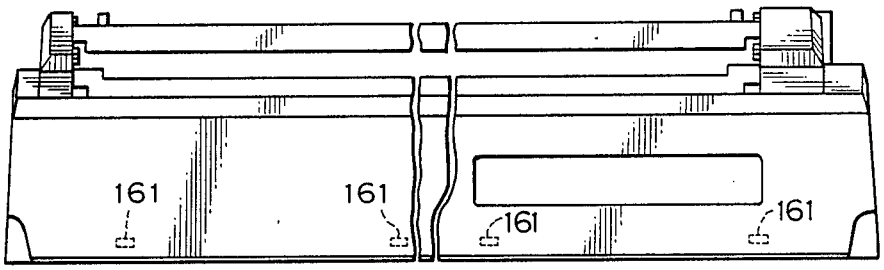
FIG. 43 is a front view of the top cover.
Figure 44:
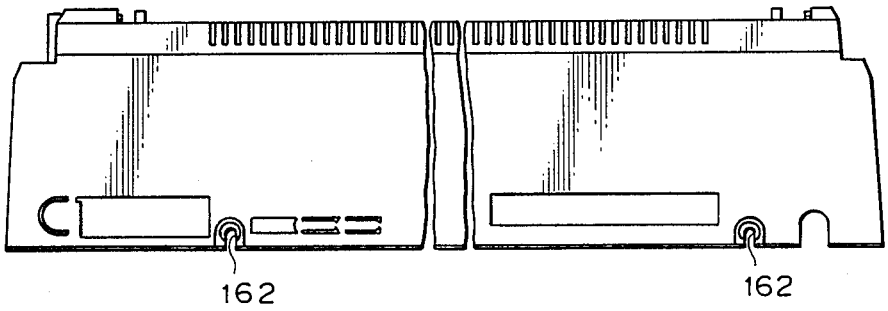
FIG. 44 is a rear view of the top cover.
Figure 45:
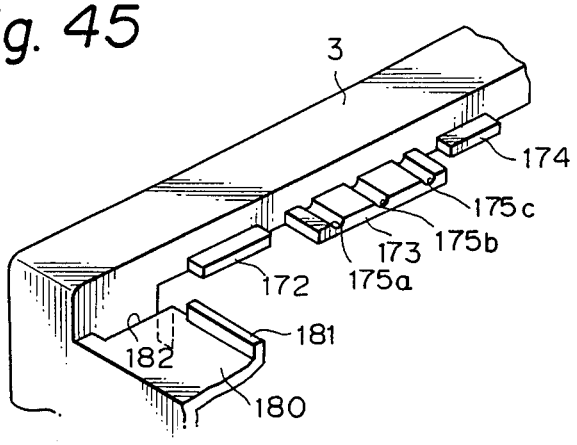
FIG. 45 is an enlarged perspective view of a guide rib portion of the top cover.
Figure 46:
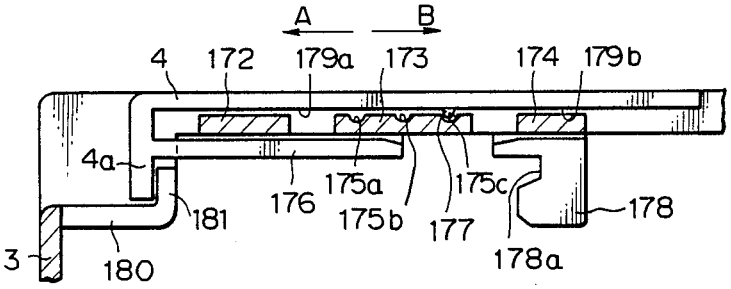
FIG. 46 is an enlarged section showing a portion where the top cover and front cover are interengaged.
Figure 47:
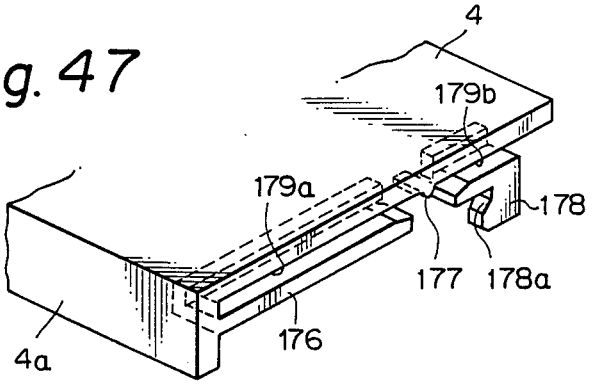
FIG. 47 is an enlarged perspective view of a guide rail, projection and hook portion of the front cover.
Figure 48:
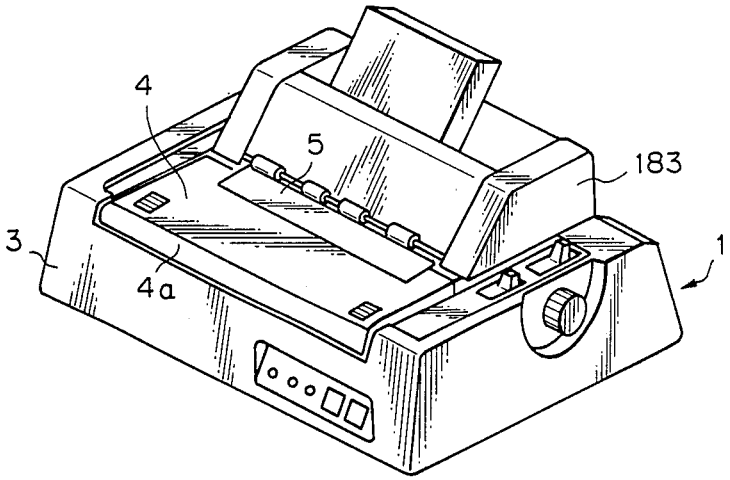
FIG. 48 is a perspective view of the printed on which an automatic paper feeder is mounted.

The front cover 4 is mounted on the top cover 3 in such a manner as to be slidable in the longitudinal direction of the printer 1 relative to the top cover 3. Specifically, the top cover 1 is provided with an opening 171 in an upper portion thereof as shown in FIG. 42, and guide ribs 172, 173 and 174 on both sides of the opening 171 as shown in FIG. 46. The guide rib 173 is formed on its top with parallel grooves 175*a*, 175*b* and 175*c* which individually extend in the lateral direction of the printer 1 and are spaced at predetermined distances from each other in the longitudinal direction of the printer 1. As shown in FIGS. 46 and 47, the front cover 4 is provided with a guide rail 176, a projection 177, and a hook 178. Guide channels 179*a* and 179*b* are defined between the front cover 4 and the guide rail 176 and between the front cover 4 and the hook 178, respectively. The hook 178 is formed with a recess 178*a* in a front portion thereof.

Further, the top cover 3 is provided on a front wall thereof with a slide plate 180 which extends toward the rear end of the printer 1. The rear end of the slide plate 180 is bent upwardly to form a stop 181. Formed at both side edges of the slide plate 180 are recesses 182 which are shaped to accommodate the hook 178. The front cover 4 is bent downwardly at its front end to form a stop 4*a* which is slidably engaged with the slide plate 180 and restricts rearward movement of the front cover 4 in engagement with the stop 181. Therefore, as shown in FIG. 46, the front cover 4 is mounted such that the guide ribs 172, 173 and 174 are received in the guide channels 179*a* and 179*b*, and is fixed in place in a position where the projection 177 becomes received in any of the grooves 175*a*, 175*b* and 175*c*.

The front cover 4 is slidable in the longitudinal direction of the printer 1 to vary the area of the opening 171 which neighbors the platen 140. This is a feature contemplated to accommodate various options which are applicable to the printer 1. Specifically, when an automatic paper feeder 183 is mounted on the printer 1 in order to automatically feed a stack of papers, the front cover 4 will be moved as indicated by an arrow A in FIG. 46 to cause the projection 177 into engagement with the groove 175*a*. In this condition, the stop 4*a* of the front cover 4 lies in substantially the same plane as the front wall of the top cover 3.

Figure 49:
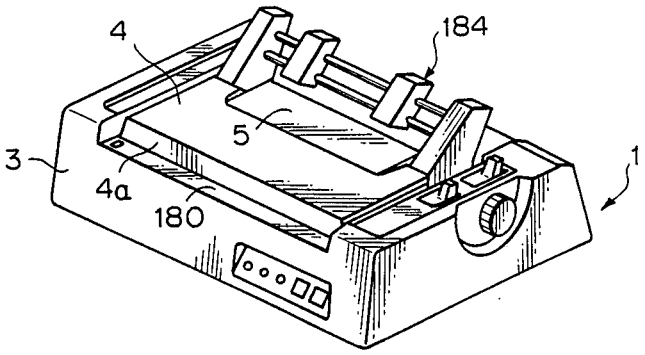
FIG. 49 is a perspective view of the printer on which a form tractor is mounted.
Figure 50:
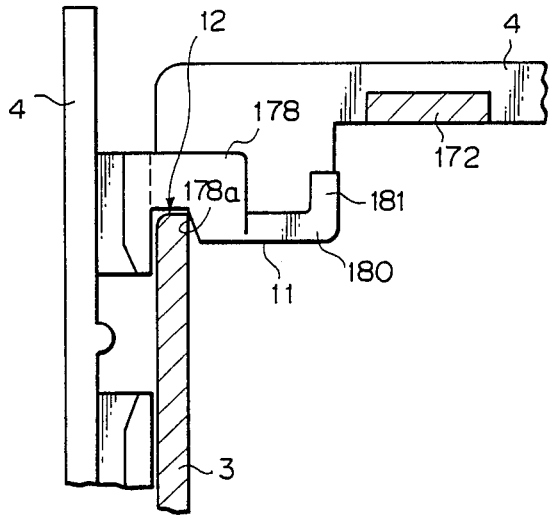
FIG. 50 is a fragmentary enlarged section showing the front cover which is caught by the top cover.
Figure 51:
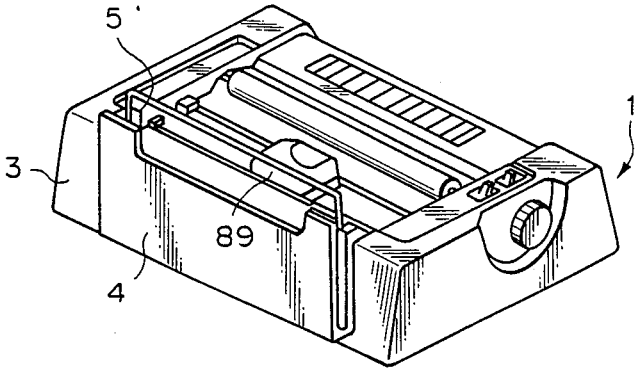
FIG. 51 is a perspective view corresponding to FIG. 50.

Alternatively, as shown in FIG. 49, when a form tractor is 184 is mounted on the printer 1 to feed a continuous paper automatically, the front cover 4 will be moved as indicated by an arrow B in FIG. 46 until the projection 177 becomes received in the groove 175*b*. In this case, although the stop 4*a* of the front cover 4 is moved away from the front wall of the top cover 3, it makes sliding contact with the slide plate 180 of the top cover 3 so that the interior of the printer 1 remains concealed. This prevents dust and other impurities from entering the printer 1 and insulates noise during printing operations.

Further, when the automatic sheet feeder 183, form tractor 184 or like optional unit is not used with the printer 1 as shown in FIG. 1, the front cover 4 is further moved in the direction B until the projection 177 becomes received in the groove 175*c*. Such a position of the front cover 4 is shown in FIG. 46. In this condition, too, the slide plate 180 and the stop 4*a* cooperate to prevent dust and others from entering the printer 1 as well as to insulate noise.

As described above, the printer 1 is capable of accommodating various optional units since the front cover 4 is slidable to an appropriate one of different positions. Hence, it is needless to prepare front covers which are associated one-to-one with optional units or to cut the front cover 4 as has heretofore been practiced at the sacrifice of cost.

When one desires to replace the ribbon cartridge 89 and/or the type wheel 69 or to perform any other work on the structural elements inside the top cover 3, he or she moves the front cover 4 in the direction A of FIG. 46 to insert the hook 178 into the recess 182 until it abuts against the front wall of the top cover 3 and, then, rotates the front side of the top cover 4 downwardly until the upper end of the front wall of the top cover 3 becomes received in the recess 178*a* to lock the front cover 4 to the top cover 3. This kind of construction, unlike prior art ones which force a person to fully remove the front cover or to raise the front cover which is hinged at the front end thereof, eliminates the need for an extra space for placing the front cover removed as stated above and the interference otherwise caused by the front cover in the raised position, thereby promoting efficient maintenance and others.

Figure 52:
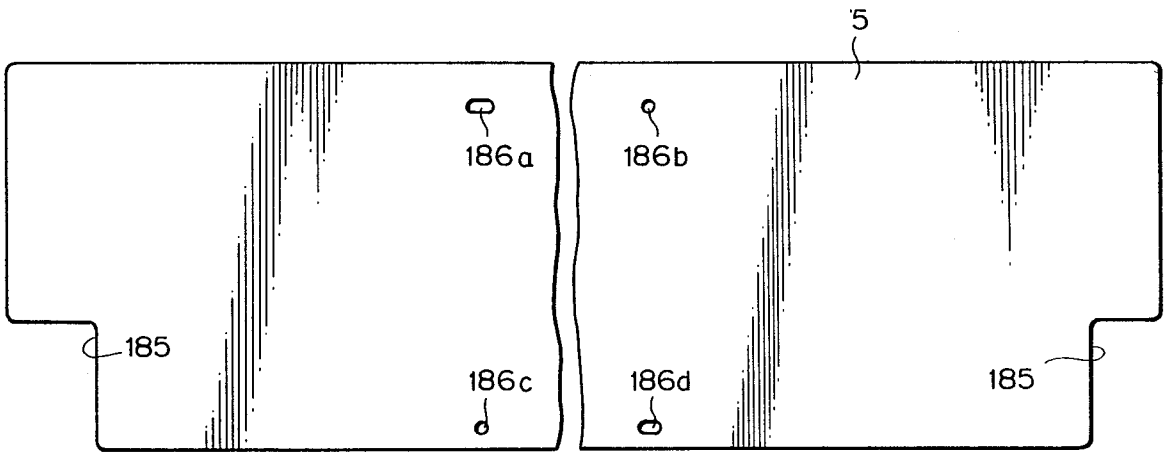
FIG. 52 is a top plan view of a sound insulating cover.

As shown in FIGS. 1, 48, 49 and 51, the sound insulating cover 5 made of transparent resin is mounted on and extends rearwardly from the front cover 4. The cover 5 serves to reduce printing noise and to allow a person to observe the printing condition through the transparent cover 5. As shown in FIG. 52, the cover 5 has a rectangular configuration and is provided with notches 185 at corner portions thereof. The cover 5 is further provided with two openings 186*a* and 186*b* at one end and two apertures 186*c* and 186*d* at the other end for mounting the cover 5 to the front cover 4.

Figure 53:
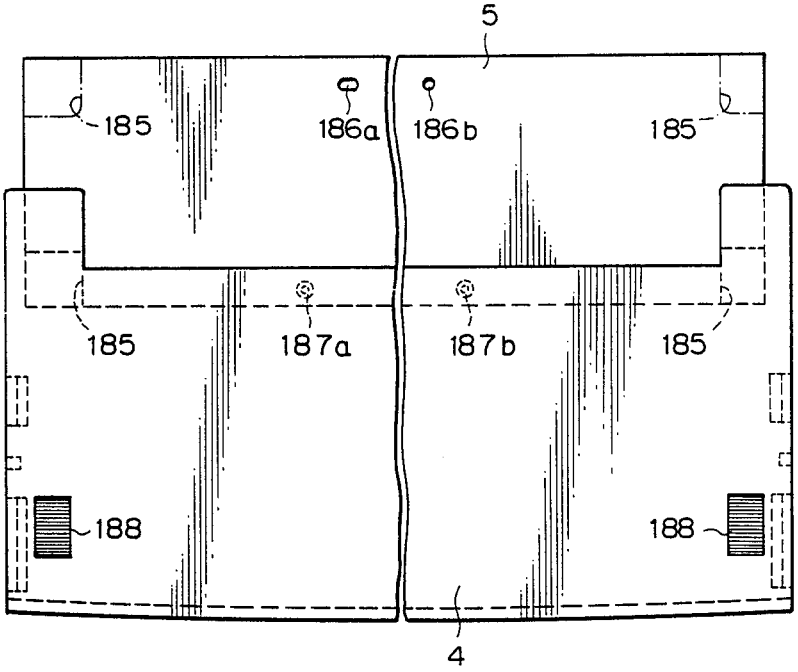
FIG. 53 is a top plan view of the sound insulating cover which is mounted on the front cover.

As shown in FIG. 53, the front cover 4 is provided with threaded openings 187*a* and 187*b*. The cover 5 is mounted to the cover 4 by driving screws into the threaded openings 187*a* and 187*b* through the openings 186*a* and 186*b* or the openings 186*c* and 186*d*. That is, when the printer 1 is used without any optional unit as shown in FIG. 1, the cover 5 is mounted to the cover 4 using the openings 186*c* and 186*d*; when it is used with the automatic paper feeder 183 of FIG. 48, form tractor 184 of FIG. 49 or like optional device mounted thereon, the cover 5 is mounted to the cover 4 using the other openings 186*a* and 186*b*. While the optional unit is mounted on the printer 1, the notches 185 serve to prevent the cover 5 from interfering with side frames of the automatic paper feeder 183 or those of the form tractor 184. At the same time, the opening 171 is covered except for a minimum necessary area so that more of the printing noise can be insulated.

As shown in FIG. 53, hook portions 188 each of which is formed with a plurality of grooves are provided on a front portion of the surface of the front cover 4 adjacent to opposite sides. The hook portions 188 facilitate manipulation of the front cover 4 in the opening and closing directions by preventing fingers which may be placed thereon from slipping.

Figure 54:
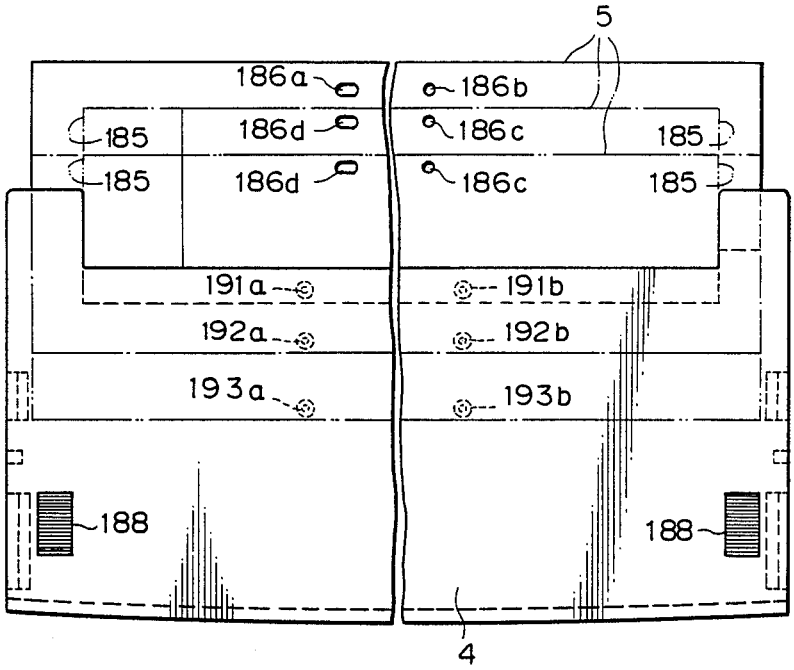
FIG. 54 is a top plan view of a front cover and a sound insulating cover which is slidably mounted on the front cover.

While the front cover has been shown and desribed as being slidable stepwise to accommodate optional units, it may be constructed and arranged to be slidable in a stepless fashion. Further, an arrangement may be made to cause the sound insulating cover to slide relative to the front cover (i.e. top cover), instead of causing the front cover to slide. For example, as shown in FIG. 54, threaded bores 191*a*, 191*b*, 192*a*, 192*b*, 193*a* and 193*b* may be formed on the back of the front cover 4 in the longitudinal direction of the printer 1 and at predetermined distances (corresponding to optional units); in which case screws will be driven into the threaded bores 191*a* and 191*b*, 192*a* and 192*b*, or 193*a* and 193*b* through the openings 186*a* and 186*b* or the openings 186*c* and 186*d*, whereby the length over which the cover 5 protrudes from the cover 4 is adjusted. That is, when no optional unit is mounted on the printer 1, screws will be driven into the threaded bores 191*a* and 191*b* through the openings 186*c* and 186*d* to fix the cover 5 as represented by a solid line in FIG. 54.

When the form tractor 184 is used with the printer 1 as an optional unit, screws will be driven into the threaded bores 192*a* and 192*b* through the openings 186*a* and 186*b* so that the cover 5 is fixed in place as indicated by a dash-and-dot line in FIG. 54. In this condition, the cover 5 successfully insulate printing noise without interfering with the side frames of the form tractor 184. Further, when the automatic paper feeder 183 is used with the printer 1, screws will be driven into the threaded bores 193*a* and 193*b* through the openings 186*a* and 186*b* so as to fix the cover 5 in a position as represented by a dash-and-dots line in FIG. 54. In this case, too, the cover 5 may naturally be constructed and arranged to slide in a stepless manner relative to the front cover 4.

In this particular embodiment, means for setting up the mounting position of the carriage 52 to the carrier 51 is implemented with the bearings 53*a* and 53*b* of the carrier 51 and using a position where the side walls 52*a* and 52*b* of the carriage 52 make contact with the bearings 53*a* and 53*b* as a reference. Alternatively, as shown in FIG. 55, such means may be accomplished by forming a reference plate 196 during the course of press-forming the carrier 51. Specifically, in FIG. 55, the reference plate 196 is provided with a reference groove 197 for receiving the catch bar 73 of the carriage 52. The catch bar 73 received in the groove 197 as stated is retained by the catcher 72. Because the catch bar 73 is retained in the groove 197 by the reference plate 196 and catcher 72 as mentioned above, not only longitudinal oscillations but also lateral oscillations of the carriage 52 are further suppressed to offer an extra improvement in printing accuracy.

Control of the printer 1 having the above construction will be described hereinafter.

Figures 56, 56A:
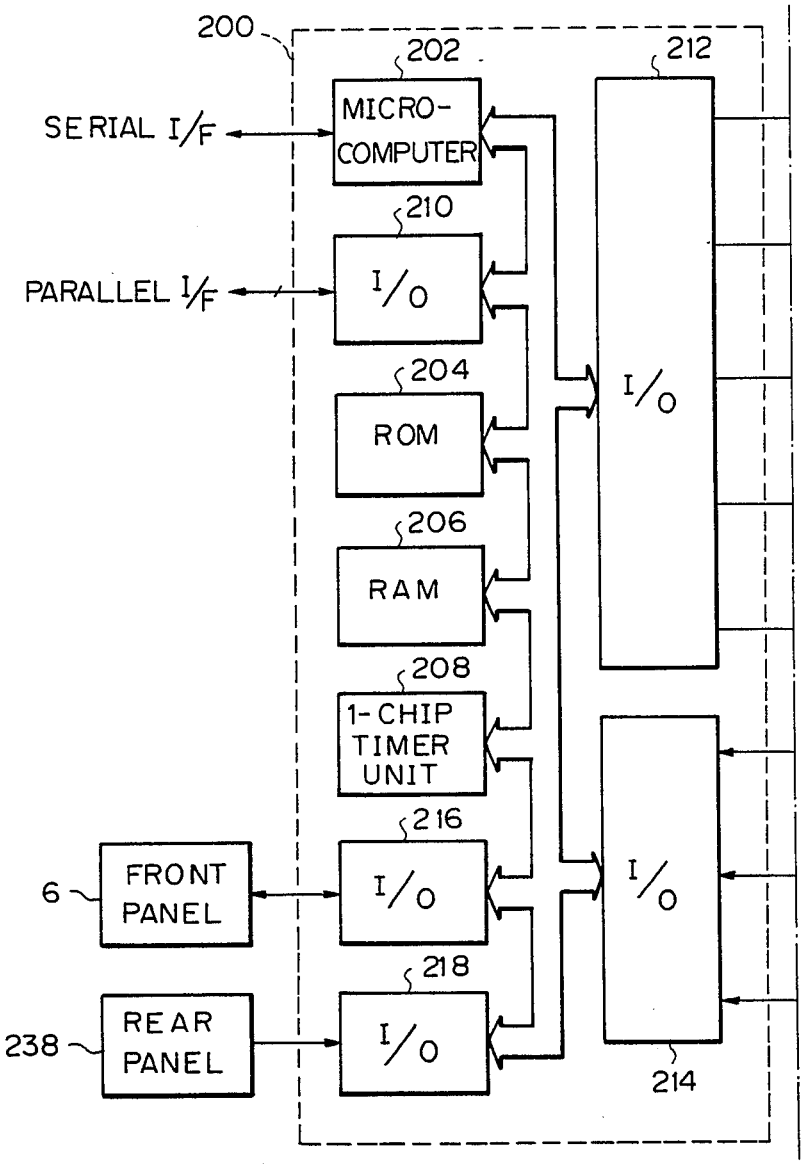
FIG. 56 is a block diagram of a control device which is installed in the printer.
Figure 56B:
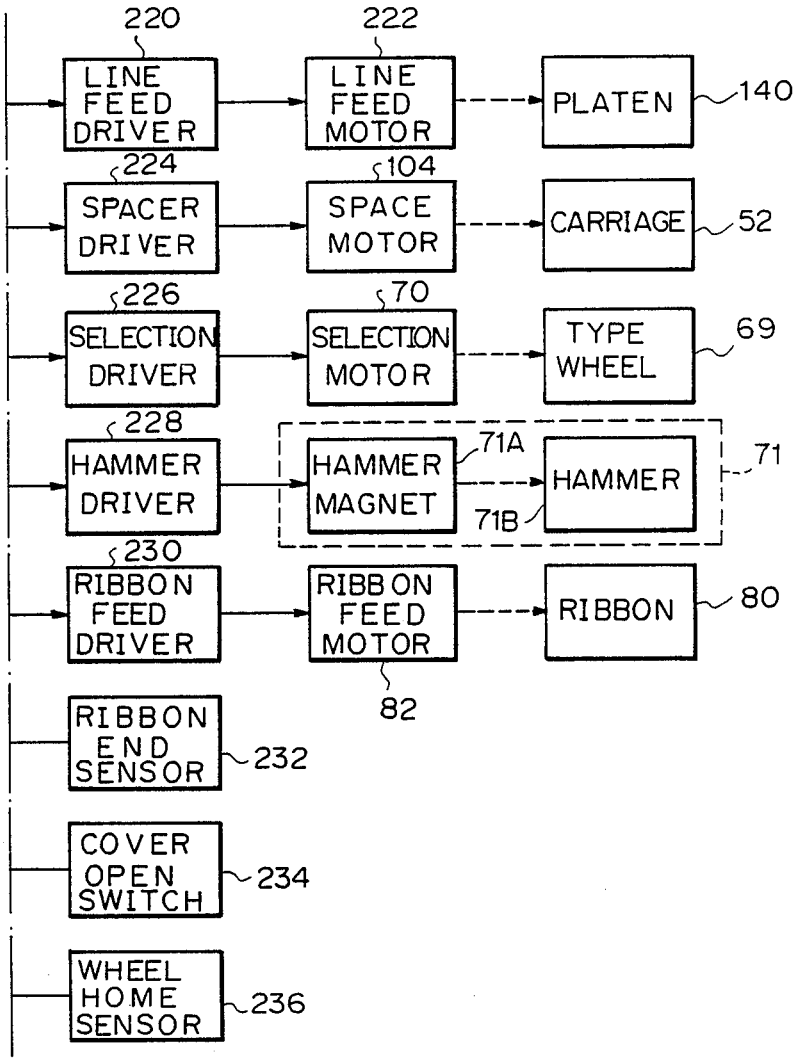

Referring to FIG. 56, a specific construction of a control device which is installed in the printer 1 is shown in a block diagram. As shown, a main controller 200 consists of a mirocomputer 202, a read only memory (ROM) 204, a random access memory (RAM) 206, a one-chip timer unit 208 in which three timers are built in, an I/O 210 adapted for parallel interface, and I/Os 212, 214, 216 and 218, etc. The three timers of the timer unit 208 are controlled by the microcomputer 202 to set up a time independently of each other.

The microcomputer 202 has therein a CPU, a ROM, a RAM, an I/O and others and bifunctions as counting means adapted to control the whole printer. Built in the microcomputer 202 are three eight-bit timers two of which are assigned to space control and selection control, respectively, and the remaining one is used as a 1-millisecond timer which generates an interruption every 1 millisecond. The ROM 204 constitutes a program area which stores a control program associated with, for example, printout control of the printer 1, a conversion table area which stores a print pressure table for converting character codes into type element positions (wheel addresses), a proportional space table for converting them into proportional space amounts, and other tables, and an area which stores fixed data such as a velocity table. The RAM 206, on the other hand, constitutes a receive buffer for temporarily storing data received from a host machine (e.g. word processor, office computer, personal computer), a user area for down-loading various kinds of user data supplied from the host, a working area (including data area) for executing a program. The three timers of the timer unit 208 are respectively used as a timer for hammer main drive, a timer for hammer re-drive, and a timer for baud rate generator.

Character code, space (SP) data, line feed (LF) data, carriage returnn (CR) data and other various kinds of data are transferred from a host to a serial input terminal of the microcomputer 202 or the I/O 210. The microcomputer 202 responds to such data by performing processing based on the received data. Specifically, the microcomputer 202 delivers a line feed drive pulse to a line feed driver 220 to drive a line feed motor 222, whereby the platen 140 is rotated to feed a paper by a predetermined amount. Also, the microcomputer 202 feeds a space drive pulse to a space driver 224 to drive the space motor 104 and, thereby, moves the carriage 52 in a predetermined direction and by a predetermined amount to a printing position. Further, the microcomputer 202 applies a selection drive pulse to a selection driver 226 to drive the selection motor 70 so that the type wheel 69 is rotated until a desired type element reaches a position where it is to be hammered by the hammer 71, i.e. impact position.

The microcomputer 202 plays another role of delivering a hammer drive pulse to a hammer driver 228. In response to the hammer drive pulse, the hammer driver 228 drives a hammer magnet 71A, which constitutes the hammer 71, so that a hammer 71B strikes the selected type element of the type wheel. The microcomputer 202 applies a ribbon feed drive pulse to a ribbon feed driver 230 to drive the ribbon feed motor 82, whereby the ribbon 80 is fed by a predetermined amount. The microcomputer 202 receives via the I/O 214 output signals of various sensors such as a ribbon end sensor 232, a cover open switch 234, a wheel home sensor 236, and a paper end sensor and a carriage home sensor which are not shown in the drawing. Further, the microcomputer 202 functions to take in operation signals outputted by a pose switch and a line feed switch which are positioned on a front panel 6, and to control turn-on and turn-off of a pose indicator, a paper end indicator, and a ribbon end indicator. Furthermore, the microcomputer 202 takes in data which may be entered through DIP switches that are located on a rear panel 238 for setting up a baud rate, protocol, code system, etc.

The operation of the control device constructed as shown and described will be explained with reference also made to FIGS. 57 to 60.

In the printer 1, counting means for updating a count every predetermined time by use of a predetermined address of the RAM which is built in the microcomputer 202 (hereinafter referred to as a free-run counter) is implemented with firmware. Specifically, using one of the timers installed in the microcomputer 202, an interruption is generated every 1 millisecond and, during the course of interrupt processing, the count of the free-run counter is updated.

Figure 57:
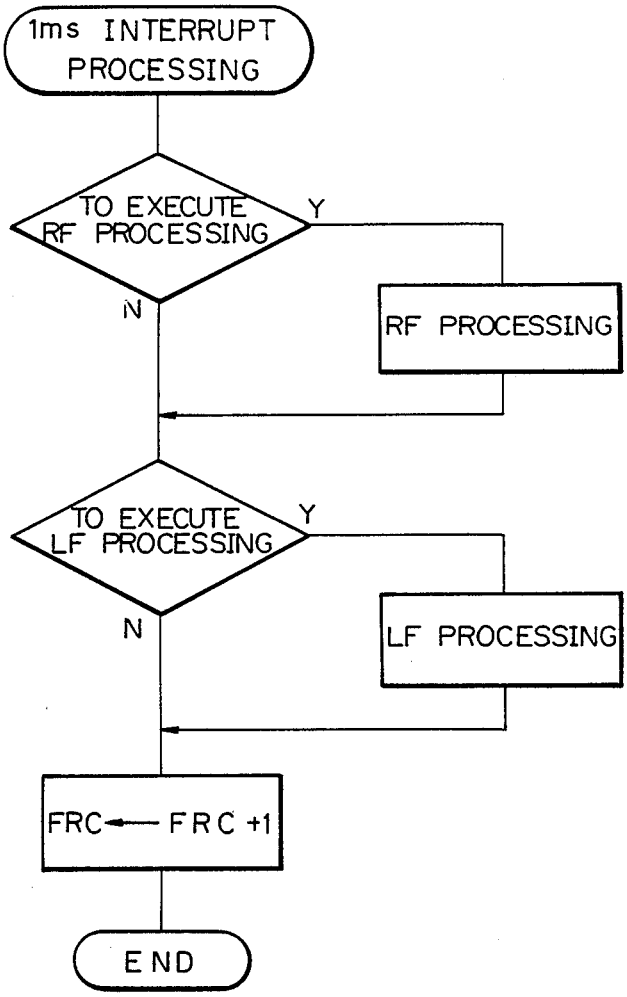
FIG. 57 is a flowchart useful for the explanation of a free-run counter which is defined in a random access memory (RAM) of a main controller.

The 1-millisecond interrupt processing will be described with reference to FIG. 57. Upon generation of a 1-millisecond interrupt request, the microcomputer 202 determines whether or not a ribbon feed flag is set so as to see if ribbon feed (RF) processing is necessary. After executing the RF processing if it is necessary, the microcomputer 202 determines whether or not a line feed flag is set to see if line feed (LF) processing is necessary. After executing the LF processing if it is necessary, the microcomputer 202 increments (+1) the content of the predetermined RAM address, i.e., the free-run counter FRC and, then, returns. Hence, the count of the free-run counter FRC is updated every predetermined time, i.e., 1 millisecond from an instant when interrupt processing is enabled after the turn-on of a power switch of the printer 1 to an instant when the power switch is turned off.

Assume that two of predetermined addresses of the eight-bit RAM 206 are used as the free-run counter, i.e., the free-run counter comprises two bytes (sixteen bits). Then, as shown in FIG. 58, because the first to the sixteenth bits are provided with different numerical weights (first bit=1, second bit=2, . . . , sixteenth bit=32,768), the two-byte free-run counter FRC is capable of counting "0" up to "65,535 (=1+2+ . . . +32,768)." Therefore, as the free-run counter FRC is incremented by the interrupt processing which is performed every 1 millisecond as stated, a count upon the lapse of 10 seconds since a time when the count of the counter FRC was "0" (all bits are "0") as shown in FIG. 59A is "10000" as shown in FIG. 59B, and upon the lapse of 55.535 seconds the count becomes "65,535" (all bits are "1") as shown in FIG. 59C. As 1 millisecond elapses, the count of the counter FRC is restored to "0" as shown in FIG. 59D. Afterward, the count of the counter FRC begins to be incremented again with the lapse of time.

In this manner, concerning a two-byte free-run counter FRC, it is repeatedly incremented from "0" to "65535" every 1 millisecond and, therefore, capable of counting time up to 65.535 seconds.

Hereinafter will be described various kinds of control to which the free-run counter is applicable.

In the printer 1, the pose lamp, paper end indicator and ribbon end indicator which are arranged on the front panel 6 are controlled to flash at predetermined time intervals when turned on. The pose switch and line feed switch on the front panel 6 are monitored. Further, the statuses of the baud rate swtich, protocol switch, space pitch switch, auto-line switch, line pitch switch, form length switch, wheel switch which are located on the rear panel 238 are monitored at predetermined time intervals. It is to be noted that the decision of the status of any of the switches is made upon the lapse of a predetermined time after switch-on for accuracy purpose. An arrangement is made such that when a space code or a line feed code has been continuously applied to the receive buffer, a space operation or a line feed operation is performed in response to entry of a code other than the space and line feed codes. Hence, when no code has been entered after a sequence of space codes or that of line feed codes, whether a predetermined time elapses before the reception of data is monitored and, if it elapses without any data entered, a space operation or a line feed operation is performed (this processing will hereinafter be referred to as optimizer processing). When the status of a bail open switch which comprises a microswitch responsive to positions of a paper bail, not shown, is to be decided, the decision is not performed until an output signal of the switch becomes stable in order to avoid chattering of the signal.

Other kinds of control which are based on time may include energization control of an operator call buzzer and that of a buzzer responsive to errors, and control of drive of a sheet feed motor and a solenoid which are associated with a sheet feed device (automatic paper feeder, form tractor, etc).

The following description will concentrate on a specific case wherein printer monitor processing is executed by use of a freerun counter.

Figure 60A:
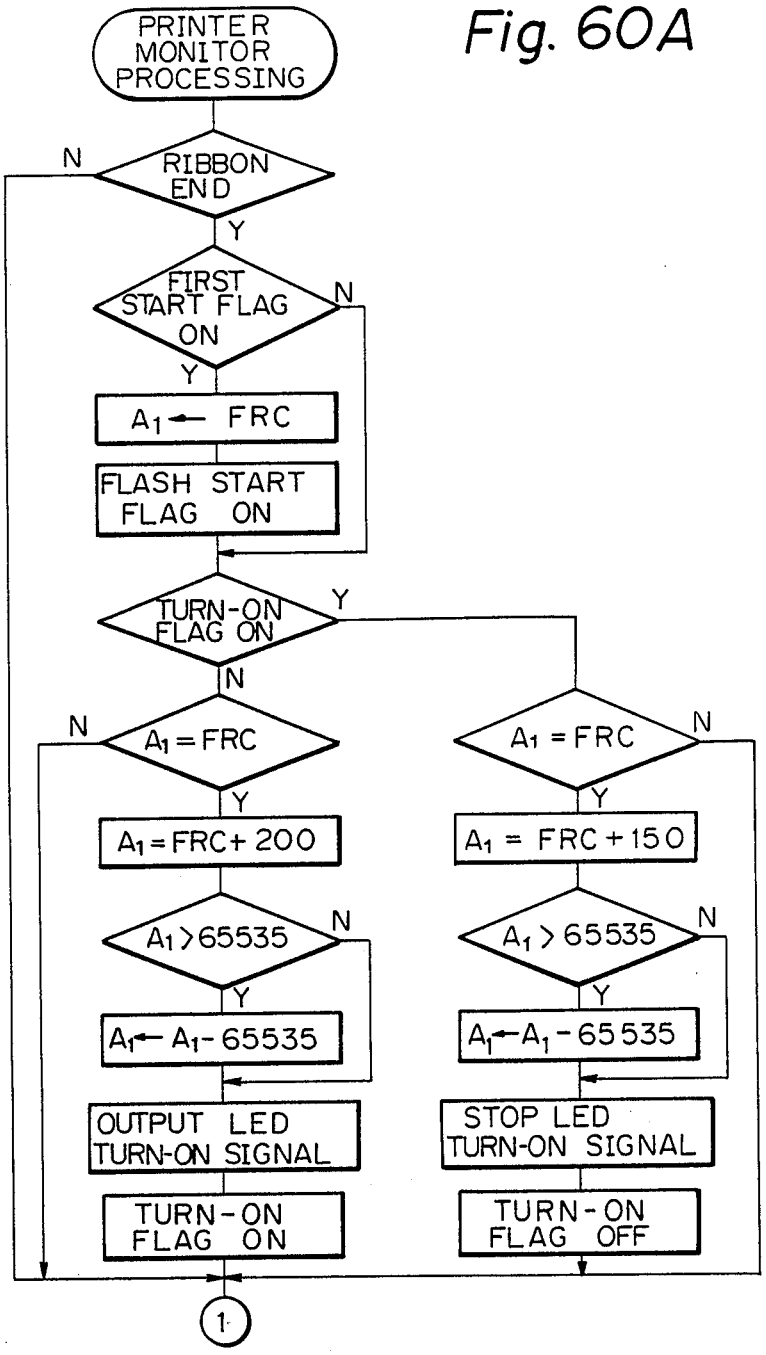
FIG. 60 is a flowchart demonstrating one example of printer monitor control which the microcomputer performs.
Figure 60B:
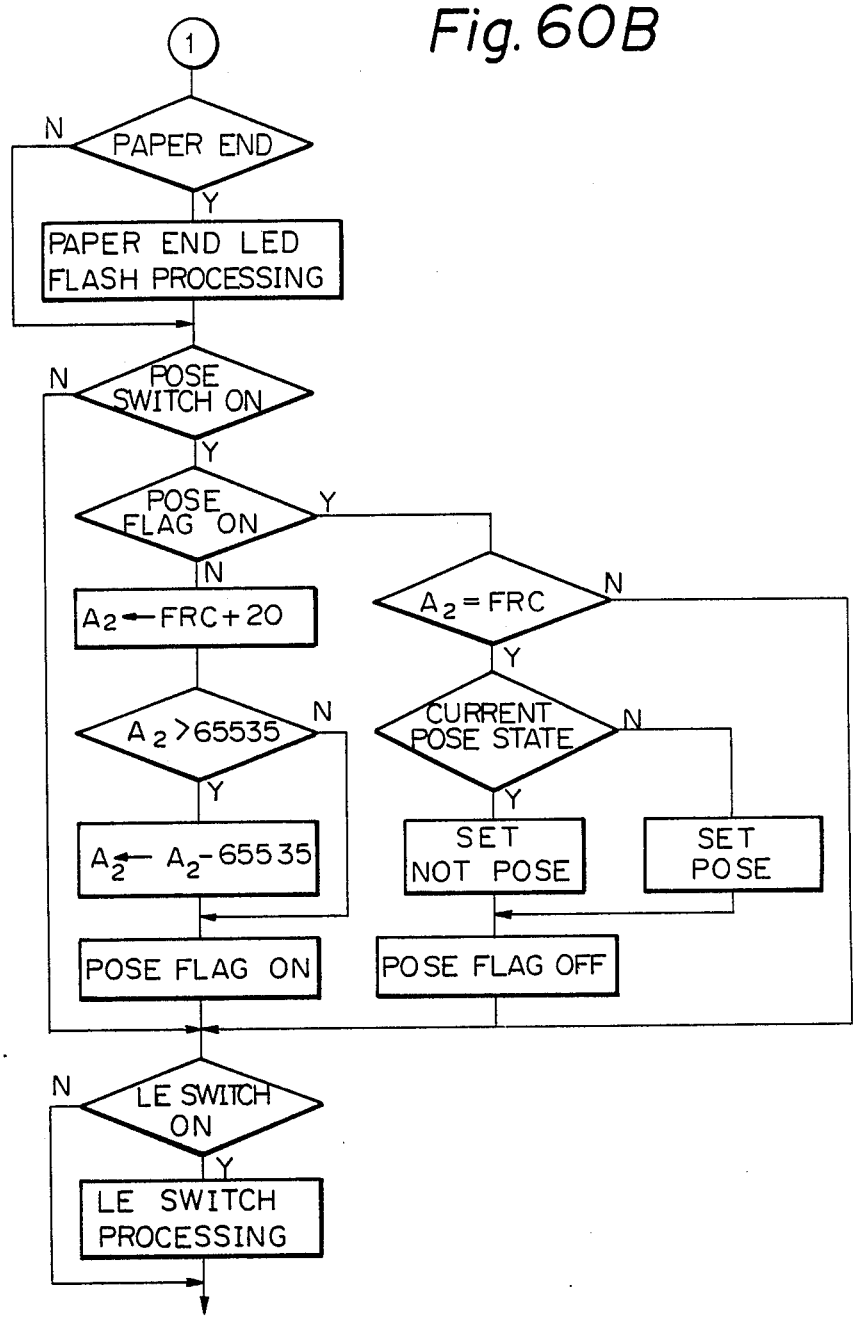

Referring to FIG. 60, the printer monitor processing begins with checking the ribbon end sensor 232 to see if the end of a ribbon has been reached. If the result is positive, whether a flash start flag is set (ON) is determined. If flashing has not been started (flash start flag=OFF), the count of the free-run counter FRC is loaded in an end counter $A_1$ ($A_1 \leftarrow FRC$) and, at the same time, the flash start flag is set. Next, whether a turn-on flag is set is decided to see if the ribbon end indicator is turned on at that time. If the ribbon indicator is not turned on (turn-on flag=OFF), then whether the count of the end counter $A_1$ and that of the free-run counter FRC are equal ($A_1=FRC$) is decided.

If $A_1=FRC$ does not hold, meaning that the turn-off condition has not continued 150 milliseconds yet, the turn-off condition of the paper end indicator is maintained. If $A_1=FRC$ holds, then a value produced by adding 200 (milliseconds) to the count of the free-run counter FRC is loaded in the end counter $A_1$ ($A_1 \leftarrow FRC+200$). This is followed by deciding whether the content of the end counter $A_1$ is greater than "65,535" which is the maximum value to be counted by the counter FRC ($A_1$ ) 65,535). If $A_1>65,535$ is decided, a value produced by subtracting "65,535" from the end counter $A_1$ is loaded in the end counter $A_1$ ($A_1 \leftarrow A_1-65,535$). If not $A_1>65,535$, the content of the end counter $A_1$ is not changed. Thereafter, a turn-on signal is delivered to the ribbon end indicator and, then, the turn-on flag is set.

When the ribbon end indicator has been turned on (turn-on flag=ON), whether the count of the free-run counter FRC is equal to that of the end counter $A_1$ ($A_1=FRC$) is decided. If not $A_1=FRC$, meaning that 200 milliseconds has not expired yet since the beginning of the turn-on of the ribbon end indicator, the turn-on condition of the indicator is maintained. If $A_1=FRC$ is decided, then a value produced by adding 150 (milliseconds) to the free-run counter FRC is loaded in the end counter $A_1$ ($A_1 \leftarrow FRC+150$). Subsequently, whether the content of the end counter $A_1$ is greater than "65,535" which is the maximum value to be counted by the counter FRC ($A_1>65,535$) is determined. If $A_1>65,535$ is decided, a value produced by subtracting "65,535" from the end counter $A_1$ is loaded in the end counter $A_1$ ($A_1 \leftarrow A_1-65,535$); if not, the count of the end counter $A_1$ is not changed. Thereafter, the turn-on signal to the paper end indicator is interrupted to turn it off and, then, the turn-on flag is reset.

By the above-described procedure, when ribbon end has occurred, the ribbon end indicator is turned on for 200 milliseconds and turned off for 140 milliseconds in a flashing fashion.

Upon completion of the ribbon end monitor processing, the paper end sensor is checked to see if the end of paper has been reached. If it has been reached, flash processing is performed on the paper end indicator in the same manner as the ribbon end procedure.

Subsequently, whether the pose switch is turned on is decided and, if so, whether a pose flag is set is determined to see if the pose switch has already been depressed. If the pose flag is not set, a value produced by adding 20 (milliseconds) to the free-run counter FRC is loaded in an end counter $A_2$ ($A_2 \leftarrow FRC+20$). Then, whether the end counter $A_2$ is greater than "65,535" which is the maximum value to be counted by the counter FRC ($A_2>65,532$) is decided and, if the result is positive, a value produced by subtracting "65,535" from the end counter $A_2$ is loaded in the end counter $A_2$ ($A_2 \leftarrow A_2$ 65,535); if the result is negative, the pose flag is set without changing the content of the counter $A_2$.

If the pose flag is not set, whether the content of the end counter $A_2$ is equal to that of the free-run counter FRC ($A_2=FRC$) is decided. If $A_2=FRC$ does not hold, meaning that not more than 20 milliseconds has elapsed after the depression of the pose switch, the operation of the pose switch is not decided effective. As soon as $A_2=FRC$ holds, implying the lapse of 20 milliseconds after the depression of the pose switch, the operation of the pose switch is decided effective. This is followed by determining whether the current condition is a pose condition and, if it is a pose condition, a not pose condition is set up; if it is not a pose condition, a pose condition is set up and, then, the pose flag is reset. Deciding that the operation of the pose switch is effective only when the switch has been depressed for 20 milliseconds is to enhance accuracy.

It is to be noted that the switch monitor processing as explained above is applicable not only to the switches which are disposed on the front panel 6 and rear panel 238 but also to any other switches such as the bail open switch, as previously stated. In any case, the procedure described avoids chattering of a signal in the event when the switch is turned on and off, thereby promoting the accuracy of decision.

After the pose switch monitor processing as described above, LF switch processing is executed to monitor the line feed switch.

It will be understood from the printer monitor processing that in processing of the kind which counts time by use of a free-run counter various times consumed are added on a processing-by-processing basis with a count which holds at the start of counting used as a reference, thereby determining the count of the free-run counter upon the lapse of time. Hence, the procedure is applicable to all the possible kinds of processing which require precision on the order of milliseconds and, in addition, a plurality of different kinds of processing can share a single free-run counter to cut down the cost.

As described above, the printer 1 is provided with counting means which updates the count thereof every predetermined time so that different kinds of processing can share a single timer (time counting means).

While in the embodiment of the present invention is applied to a two-byte area and the maximum time of 65.535 seconds to be counted, a longer time can be counted if the number of bytes of the free-run counter is increased. The RAM built in a computer as stated above may be replaced with any other storages which can be rewritten. Further, it will be apparent that the printer of the type using a type wheel to which the embodiment is applied may be replaced with a dot impact printer, thermal printer, thermal transfer printer, ink jet printer, optical printer, LED printer, and other various kinds of printers as well as an electronic typewriter and other printing devices.

As described hereinabove, the present invention achieves various unprecedented advantages as enumerated below.

(1) A carrier and a carriage which are each produced by press-forming a sheet metal cut down the production cost of themselves and that of their associated parts and, therefore, that of a printing device as a whole.

(2) Because a space wire and a carrier are interconnected by connecting a fixing plate which is mounted on the space wire beforehand to the carrier, the interconnection is simple and easy and the mounting position of the carrier to the space wire is accurate.

(3) A space motor is positioned horizontally long to reduce the vertical dimension thereof and, therefore, that of a printing device.

(4) A reference printing position can be set up accurately without the need for extra mechanisms otherwise installed in a carriage and carrier, cutting down the cost of a printing device.

(5) A platen can be readily aligned in axis and reduced in weight and cost.

(6) A paper feed mechanism is simplified to cut down the cost.

(7) Because what should be taken into account in mounting an idle gear is the backlash between the idle gear and a platen gear only, the idle gear can be mounted in a simple and easy manner to enhance efficient assemblage of a printing device as well as accurate printing.

(8) By press-forming a sheet metal, a base cover can be readily formed with projections and others for mounting electrical circuit elements and printing mechanisms and, in addition, the base cover can serve as grounding means, a heat sink and a shield through the projections and others, reducing the cost and weight of a printing device.

(9) Different kinds of processing can share a single timer.

Various modifications will become possible for those skilled in the art after receiving the teachings of the present disclosure without departing from the scope thereof.

What is claimed is:

1. A printing device comprising a carrier (51), a carriage (52) which is supported on said carrier (51) and in turn supports a printing device (69, 70, 71), wherein said carriage (52) is movable relative to said carrier (51) between a printing position and a print wheel changing position, a support shaft (41) on which said carrier (51) is slidably supported to move laterally along said shaft (41) and thereby permit said printing device to print out information along a print line on a record medium, and said carrier (51) is provided with bearings **(53*a*, 53*b*) engaging said shaft (41) to facilitate said sliding movement of the carrier (51) relative to said shaft (41), wherein each of said carriage (52) and carrier (51) is integrally press-formed from a respective single and continuous metal sheet, and wherein said single metal sheet from which said carriage (52) is formed includes portions which rest on and abut said bearings (53*a*, 53*b*) when said carriage (52) is in said printing position to thereby fix the vertical position of said printing device (69, 70, 71)** relative to said printing line.

2. A printing device as in claim 1 in which said single metal sheet from which said carrier (51) is formed includes laterally extending support portions **(51*d*, 51*e*)**.

3. A printing device as in claim 2 in which said laterally extending support portions **(51*d*, 51*e*) are individually provided with retaining portions (90*a*, 90*b*) for supporting a ribbon cartridge (89)**.

4. A printing device as in claim 3 including a ribbon feed mechanism (81) mounted on one of said laterally extending support portions **(51*d*)**.

5. A printing device as in claim 4 in which said said single metal sheet from which said carrier (51) is formed includes a rear support portion (54) for supporting said carriage (52) and including a slider (55) mounted on said rear support portion (54) to abut said rear support means (54) to thereby support a rear portion of said carriage (52).

6. A printing device as in claim 2 including a ribbon feed mechanism (81) mounted on one of said laterally extending support portions **(51*d*)**.

7. A printing device as in claim 6 in which said said single metal sheet from which said carrier (51) is formed further includes a rear support portion (54) for supporting said carriage (52) and including a slider (55) mounted on said rear support portion (54) to abut said rear support means (54) to thereby support a rear portion of said carriage (52).

8. A printing device as in claim 1 in which said said single metal sheet from which said carrier (51) is formed includes a rear support portion (54) for supporting said carriage (52) and including a slider (55) mounted on said rear support portion (54) to abut said rear support means (54) to thereby support a rear portion of said carriage (52).

* * * * *